US010769931B2

(12) United States Patent
Krein et al.

(10) Patent No.: US 10,769,931 B2
(45) Date of Patent: Sep. 8, 2020

(54) NETWORK JAMMING DETECTION AND REMEDIATION

(71) Applicant: Ooma, Inc., Sunnyvale, CA (US)

(72) Inventors: William T. Krein, Loomis, CA (US); David A. Bryan, Cedar Park, TX (US); Arvind Vasudev, Sunnyvale, CA (US)

(73) Assignee: Ooma, Inc., Sunnyvale, CA (US)

( * ) Notice: Subject to any disclaimer, the term of this patent is extended or adjusted under 35 U.S.C. 154(b) by 0 days.

(21) Appl. No.: 16/112,409

(22) Filed: Aug. 24, 2018

(65) Prior Publication Data

US 2018/0365969 A1 Dec. 20, 2018

Related U.S. Application Data

(63) Continuation-in-part of application No. 15/369,655, filed on Dec. 5, 2016, now Pat. No. 10,255,792, which is a continuation of application No. 14/283,132, filed on May 20, 2014, now Pat. No. 9,633,547.

(51) Int. Cl.

| | |
|---|---|
| ***G08B 13/00*** | (2006.01) |
| ***G08B 25/00*** | (2006.01) |
| ***G08B 25/08*** | (2006.01) |
| ***G08B 13/02*** | (2006.01) |
| ***G08B 25/10*** | (2006.01) |
| ***H04K 3/00*** | (2006.01) |

(52) U.S. Cl.

CPC ..... *G08B 25/00* (2013.01); *G08B 13/02* (2013.01); *G08B 25/001* (2013.01); *G08B 25/006* (2013.01); *G08B 25/008* (2013.01); *G08B 25/08* (2013.01); *G08B 25/10* (2013.01); *H04K 3/22* (2013.01); *H04K 2203/16* (2013.01); *H04K 2203/18* (2013.01)

(58) Field of Classification Search

None

See application file for complete search history.

(56) References Cited

U.S. PATENT DOCUMENTS 5,323,444 A 6/1994 Ertz et al.
5,425,085 A 6/1995 Weinberger et al.
(Continued)

FOREIGN PATENT DOCUMENTS

CA 2949211 C 2/2019
CA 2954351 C 4/2020
(Continued)

OTHER PUBLICATIONS

"International Search Report" and "Written Opinion of the International Searching Authority," Patent Cooperation Treaty Application No. PCT/US2014/044945, dated Nov. 7, 2014, 12 pages.
(Continued)

*Primary Examiner* — Julie B Lieu
(74) *Attorney, Agent, or Firm* — Carr & Ferrell LLP

(57) ABSTRACT

Methods and systems for network jamming detection and remediation are provided. Exemplary methods include: detecting by a base unit network jamming, the base unit being disposed in a residence; and issuing an alert in response to the detected network jamming, the alert being last least one of: sounding an audible alarm, showing a visual alarm indication, communicating with law enforcement, and communicating with an alarm monitoring station.

20 Claims, 11 Drawing Sheets

(56) References Cited

U.S. PATENT DOCUMENTS 5,463,595 A 10/1995 Rodhall et al.
5,519,769 A 5/1996 Weinberger et al.
5,596,625 A 1/1997 LeBlanc
5,598,460 A 1/1997 Tendler
5,796,736 A 8/1998 Suzuki
5,999,611 A 12/1999 Tatchell et al.
6,023,724 A 2/2000 Bhatia et al.
6,128,481 A 10/2000 Houde et al.
6,148,190 A 11/2000 Bugnon et al.
6,201,856 B1 3/2001 Orwick et al.
6,202,169 B1 3/2001 Razzaghe-Ashrafi et al.
6,266,397 B1 7/2001 Stoner
6,377,938 B1 4/2002 Block et al.
6,487,197 B1 11/2002 Elliott
6,594,246 B1 7/2003 Jorgensen
6,615,264 B1 9/2003 Stoltz et al.
6,661,340 B1 12/2003 Saylor et al.
6,690,932 B1 2/2004 Barnier et al.
6,697,358 B2 2/2004 Bernstein
6,714,545 B1 3/2004 Hugenberg et al.
6,775,267 B1 8/2004 Kung et al.
6,778,517 B1 8/2004 Lou et al.
6,778,528 B1 8/2004 Blair et al.
6,781,983 B1 8/2004 Armistead
6,914,900 B1 7/2005 Komatsu et al.
6,934,258 B1 8/2005 Smith et al.
7,113,090 B1 9/2006 Saylor et al.
7,124,506 B2 10/2006 Yamanashi et al.
7,127,043 B2 10/2006 Morris
7,127,506 B1 10/2006 Schmidt et al.
7,154,891 B1 12/2006 Callon
7,280,495 B1 10/2007 Zweig et al.
7,295,660 B1 11/2007 Higginbotham et al.
7,342,925 B2 3/2008 Cherchali et al.
7,376,124 B2 5/2008 Lee et al.
7,394,803 B1 7/2008 Petit-Huguenin et al.
7,599,356 B1 10/2009 Barzegar et al.
7,733,859 B2 6/2010 Takahashi et al.
7,844,034 B1 11/2010 Oh et al.
8,098,798 B2 1/2012 Goldman et al.
8,140,392 B2 3/2012 Altberg et al.
8,180,316 B2 5/2012 Hwang
8,208,955 B1 6/2012 Nelson
8,331,547 B2 12/2012 Smith et al.
8,350,694 B1 1/2013 Trundle et al.
8,515,021 B2 8/2013 Farrand et al.
8,577,000 B1 11/2013 Brown
8,634,520 B1 1/2014 Morrison et al.
8,837,698 B2 9/2014 Altberg et al.
8,988,232 B1 3/2015 Sloo et al.
9,087,515 B2 7/2015 Tsuda
9,147,054 B1 9/2015 Beal et al.
9,179,279 B2 11/2015 Zussman
9,225,626 B2 12/2015 Capper et al.
9,386,148 B2 7/2016 Farrand et al.
9,386,414 B1 7/2016 Mayor et al.
9,426,288 B2 8/2016 Farrand et al.
9,521,069 B2 12/2016 Gillon et al.
9,560,198 B2 1/2017 Farrand et al.
9,633,547 B2 4/2017 Farrand et al.
9,667,782 B2 5/2017 Farrand et al.
9,787,611 B2 10/2017 Gillon et al.
9,826,372 B2 11/2017 Jeong
9,905,103 B2 2/2018 Hsieh
9,929,981 B2 3/2018 Gillon et al.
10,009,286 B2 6/2018 Gillon et al.
10,116,796 B2 10/2018 Im et al.
10,135,976 B2 11/2018 Farrand et al.
10,158,584 B2 12/2018 Gillon et al.
10,192,546 B1 1/2019 Piersol et al.
10,255,792 B2 4/2019 Farrand et al.
10,263,918 B2 4/2019 Gillon et al.
10,297,250 B1 5/2019 Blanksteen et al.
10,341,490 B2 7/2019 Im et al.
10,469,556 B2 11/2019 Frame et al.
10,553,098 B2 2/2020 Hart et al.
2001/0053194 A1 12/2001 Johnson
2002/0016718 A1 2/2002 Rothschild et al.
2002/0035556 A1 3/2002 Shah et al.
2002/0037750 A1 3/2002 Hussain et al.
2002/0038167 A1 3/2002 Chirnomas
2002/0057764 A1 5/2002 Salvucci et al.
2002/0085692 A1 7/2002 Katz
2002/0130784 A1 9/2002 Suzuki et al.
2002/0133614 A1 9/2002 Weerahandi et al.
2002/0140549 A1 10/2002 Tseng
2002/0165966 A1 11/2002 Widegren et al.
2003/0027602 A1 2/2003 Han et al.
2003/0058844 A1 3/2003 Sojka et al.
2003/0099334 A1 5/2003 Contractor
2003/0119492 A1 6/2003 Timmins et al.
2003/0133443 A1 7/2003 Klinker et al.
2003/0141093 A1 7/2003 Tirosh et al.
2003/0158940 A1 8/2003 Leigh
2003/0164877 A1 9/2003 Murai
2003/0184436 A1 10/2003 Seales et al.
2003/0189928 A1 10/2003 Xiong
2004/0001512 A1 1/2004 Challener et al.
2004/0010472 A1 1/2004 Hilby et al.
2004/0010569 A1 1/2004 Thomas et al.
2004/0017803 A1 1/2004 Lim et al.
2004/0059821 A1 3/2004 Tang et al.
2004/0086093 A1 5/2004 Schranz
2004/0090968 A1 5/2004 Kimber et al.
2004/0105444 A1 6/2004 Korotin et al.
2004/0160956 A1 8/2004 Hardy et al.
2004/0235509 A1 11/2004 Burritt et al.
2005/0027887 A1 2/2005 Zimler et al.
2005/0036590 A1 2/2005 Pearson et al.
2005/0053209 A1 3/2005 D'Evelyn et al.
2005/0074114 A1 4/2005 Fotta et al.
2005/0078681 A1 4/2005 Sanuki et al.
2005/0089018 A1 4/2005 Schessel
2005/0097222 A1 5/2005 Jiang et al.
2005/0105708 A1 5/2005 Kouchri et al.
2005/0141485 A1 6/2005 Miyajima et al.
2005/0169247 A1 8/2005 Chen
2005/0180549 A1 8/2005 Chiu et al.
2005/0222820 A1 10/2005 Chung
2005/0238034 A1 10/2005 Gillespie et al.
2005/0238142 A1 10/2005 Winegarden
2005/0246174 A1 11/2005 DeGolia
2005/0259637 A1 11/2005 Chu et al.
2005/0282518 A1 12/2005 D'Evelyn et al.
2005/0287979 A1 12/2005 Rollender
2006/0007915 A1 1/2006 Frame
2006/0009240 A1 1/2006 Katz
2006/0013195 A1 1/2006 Son et al.
2006/0059238 A1 3/2006 Slater et al.
2006/0071775 A1 4/2006 Otto et al.
2006/0092011 A1 5/2006 Simon et al.
2006/0114894 A1 6/2006 Cherchali et al.
2006/0140352 A1 6/2006 Morris
2006/0156251 A1 7/2006 Suhail et al.
2006/0167746 A1 7/2006 Zucker
2006/0187898 A1 8/2006 Chou et al.
2006/0187900 A1 8/2006 Akbar et al.
2006/0206933 A1 9/2006 Molen et al.
2006/0243797 A1 11/2006 Apte et al.
2006/0251048 A1 11/2006 Yoshino et al.
2006/0258341 A1 11/2006 Miller et al.
2006/0259767 A1 11/2006 Mansz et al.
2006/0268828 A1 11/2006 Yarlagadda
2006/0268848 A1 11/2006 Larsson et al.
2007/0030161 A1 2/2007 Yang
2007/0032220 A1 2/2007 Feher
2007/0036314 A1 2/2007 Kloberdans et al.
2007/0037560 A1 2/2007 Yun et al.
2007/0037605 A1 2/2007 Logan
2007/0041517 A1 2/2007 Clarke et al.
2007/0049342 A1 3/2007 Mayer et al.
2007/0054645 A1 3/2007 Pan
2007/0061363 A1 3/2007 Ramer et al.
2007/0061735 A1 3/2007 Hoffberg et al.

(56) References Cited

U.S. PATENT DOCUMENTS

2007/0067219 A1 3/2007 Altberg et al.
2007/0071212 A1 3/2007 Quittek et al.
2007/0118750 A1 5/2007 Owen et al.
2007/0121593 A1 5/2007 Vance et al.
2007/0121596 A1 5/2007 Kurapati et al.
2007/0132844 A1 6/2007 Katz
2007/0133757 A1 6/2007 Girouard et al.
2007/0135088 A1 6/2007 Alessandro
2007/0153776 A1 7/2007 Joseph et al.
2007/0165811 A1 7/2007 Reumann et al.
2007/0183407 A1 8/2007 Bennett et al.
2007/0203999 A1 8/2007 Townsley et al.
2007/0223455 A1 9/2007 Chang et al.
2007/0238472 A1 10/2007 Wanless
2007/0255702 A1 11/2007 Orme
2007/0283430 A1 12/2007 Lai et al.
2007/0298772 A1 12/2007 Owens et al.
2008/0016556 A1 1/2008 Selignan
2008/0036585 A1 2/2008 Gould
2008/0049748 A1 2/2008 Bugenhagen et al.
2008/0075248 A1 3/2008 Kim
2008/0075257 A1 3/2008 Nguyen et al.
2008/0084975 A1 4/2008 Schwartz
2008/0089325 A1 4/2008 Sung
2008/0097819 A1 4/2008 Whitman, Jr.
2008/0111765 A1 5/2008 Kim
2008/0118039 A1 5/2008 Elliot et al.
2008/0125095 A1 5/2008 Mornhineway et al.
2008/0144625 A1 6/2008 Wu et al.
2008/0144884 A1 6/2008 Habibi
2008/0159515 A1 7/2008 Rines
2008/0166992 A1 7/2008 Ricordi et al.
2008/0168145 A1 7/2008 Wilson
2008/0196099 A1 8/2008 Shastri
2008/0200142 A1 8/2008 Abdel-Kader et al.
2008/0205386 A1 8/2008 Purnadi et al.
2008/0225749 A1 9/2008 Peng et al.
2008/0247401 A1 10/2008 Bhal et al.
2008/0293374 A1 11/2008 Berger
2008/0298348 A1 12/2008 Frame et al.
2008/0309486 A1 12/2008 McKenna et al.
2008/0310599 A1 12/2008 Purnadi et al.
2008/0313297 A1 12/2008 Heron et al.
2008/0316946 A1 12/2008 Capper et al.
2009/0097474 A1 4/2009 Ray et al.
2009/0106318 A1 4/2009 Mantripragada et al.
2009/0135008 A1 5/2009 Kirchmeier et al.
2009/0168755 A1 7/2009 Peng et al.
2009/0172131 A1 7/2009 Sullivan
2009/0175165 A1 7/2009 Leighton
2009/0186596 A1 7/2009 Kaltsukis
2009/0213999 A1 8/2009 Farrand et al.
2009/0224931 A1 9/2009 Dietz et al.
2009/0240586 A1 9/2009 Ramer et al.
2009/0253428 A1 10/2009 Bhatia et al.
2009/0261958 A1 10/2009 Sundararajan et al.
2009/0264093 A1 10/2009 Rothschild
2009/0295572 A1 12/2009 Grim, III et al.
2009/0303042 A1 12/2009 Song et al.
2009/0319271 A1 12/2009 Gross
2010/0003960 A1 1/2010 Ray et al.
2010/0034121 A1 2/2010 Bozionek
2010/0046530 A1 2/2010 Hautakorpi et al.
2010/0046731 A1 2/2010 Gisby et al.
2010/0077063 A1 3/2010 Amit et al.
2010/0098034 A1 4/2010 Tang et al.
2010/0098058 A1 4/2010 Delangis
2010/0098235 A1 4/2010 Cadiz et al.
2010/0114896 A1 5/2010 Clark et al.
2010/0136982 A1 6/2010 Zabawskyj et al.
2010/0158223 A1 6/2010 Fang et al.
2010/0191829 A1 7/2010 Cagenius
2010/0195805 A1 8/2010 Zeigler et al.
2010/0215153 A1 8/2010 Ray et al.
2010/0220840 A1 9/2010 Ray et al.
2010/0229452 A1 9/2010 Suk
2010/0246781 A1 9/2010 Bradburn
2010/0261448 A1 10/2010 Peters
2010/0277307 A1 11/2010 Horton et al.
2010/0302025 A1 12/2010 Script
2011/0013591 A1 1/2011 Kakumaru
2011/0047031 A1 2/2011 Weerasinghe
2011/0054689 A1 3/2011 Nielsen et al.
2011/0111728 A1 5/2011 Ferguson et al.
2011/0140868 A1 6/2011 Hovang
2011/0151791 A1* 6/2011 Snider ..... B60R 25/00 455/63.1
2011/0170680 A1 7/2011 Chislett et al.
2011/0183652 A1 7/2011 Eng et al.
2011/0208822 A1 8/2011 Rathod
2011/0265145 A1 10/2011 Prasad et al.
2011/0286462 A1 11/2011 Kompella
2011/0320274 A1 12/2011 Patil
2012/0009904 A1 1/2012 Modi et al.
2012/0010955 A1 1/2012 Ramer et al.
2012/0027191 A1 2/2012 Baril et al.
2012/0035993 A1 2/2012 Nangia
2012/0036576 A1 2/2012 Iyer
2012/0047442 A1 2/2012 Nicolaou et al.
2012/0092158 A1 4/2012 Kumbhar et al.
2012/0099716 A1 4/2012 Rae et al.
2012/0167086 A1 6/2012 Lee
2012/0177052 A1 7/2012 Chen et al.
2012/0178404 A1 7/2012 Chin et al.
2012/0180122 A1 7/2012 Yan et al.
2012/0213094 A1 8/2012 Zhang et al.
2012/0284778 A1 11/2012 Chiou et al.
2012/0320905 A1 12/2012 Ilagan
2012/0329420 A1 12/2012 Zotti et al.
2013/0018509 A1 1/2013 Korus
2013/0024197 A1 1/2013 Jang et al.
2013/0035774 A1 2/2013 Warren et al.
2013/0052982 A1 2/2013 Rohde et al.
2013/0053005 A1 2/2013 Ramer et al.
2013/0070928 A1 3/2013 Ellis et al.
2013/0111589 A1 5/2013 Cho
2013/0136241 A1 5/2013 Dillon et al.
2013/0154822 A1 6/2013 Kumar et al.
2013/0162160 A1 6/2013 Ganton et al.
2013/0162758 A1 6/2013 Shin
2013/0214925 A1 8/2013 Weiss
2013/0229282 A1 9/2013 Brent
2013/0267791 A1 10/2013 Halperin et al.
2013/0272219 A1 10/2013 Singh et al.
2013/0288639 A1 10/2013 Varsavsky Waisman-Diamond
2013/0293368 A1 11/2013 Ottah et al.
2013/0336174 A1 12/2013 Rubin et al.
2014/0011470 A1 1/2014 D'Amato et al.
2014/0022915 A1 1/2014 Caron et al.
2014/0038536 A1* 2/2014 Welnick ..... H04B 1/1027 455/154.1
2014/0066063 A1 3/2014 Park
2014/0084165 A1 3/2014 Fadell et al.
2014/0085093 A1 3/2014 Mittleman et al.
2014/0101082 A1 4/2014 Matsuoka et al.
2014/0120863 A1 5/2014 Ferguson et al.
2014/0129942 A1 5/2014 Rathod
2014/0156279 A1 6/2014 Okamoto et al.
2014/0169274 A1 6/2014 Kweon et al.
2014/0172953 A1 6/2014 Blanksteen
2014/0181865 A1 6/2014 Koganei
2014/0199946 A1 7/2014 Flippo et al.
2014/0206279 A1* 7/2014 Immendorf ..... H04K 3/40 455/1
2014/0207929 A1 7/2014 Hoshino et al.
2014/0222436 A1 8/2014 Binder et al.
2014/0253326 A1 9/2014 Cho et al.
2014/0266699 A1 9/2014 Poder et al.
2014/0273912 A1 9/2014 Peh et al.
2014/0273979 A1 9/2014 Van Os et al.
2014/0306802 A1 10/2014 Hibbs, Jr.
2014/0334645 A1 11/2014 Yun et al.
2014/0358666 A1 12/2014 Baghaie et al.
2015/0065078 A1 3/2015 Mejia et al.

(56) References Cited

U.S. PATENT DOCUMENTS

| | | | |
|---|---|---|---|
| 2015/0071450 | A1 | 3/2015 | Boyden et al. |
| 2015/0082451 | A1 | 3/2015 | Ciancio-Bunch |
| 2015/0086001 | A1 | 3/2015 | Farrand et al. |
| 2015/0087280 | A1 | 3/2015 | Farrand et al. |
| 2015/0089032 | A1 | 3/2015 | Agarwal et al. |
| 2015/0100167 | A1 | 4/2015 | Sloo et al. |
| 2015/0117624 | A1 | 4/2015 | Rosenshine |
| 2015/0138333 | A1 | 5/2015 | DeVaul et al. |
| 2015/0145693 | A1 | 5/2015 | Toriumi et al. |
| 2015/0177114 | A1 | 6/2015 | Kapoor et al. |
| 2015/0200973 | A1 | 7/2015 | Nolan |
| 2015/0221207 | A1 | 8/2015 | Hagan |
| 2015/0229770 | A1 | 8/2015 | Shuman et al. |
| 2015/0242932 | A1 | 8/2015 | Beguin et al. |
| 2015/0244873 | A1 | 8/2015 | Boyden et al. |
| 2015/0255071 | A1 | 9/2015 | Chiba |
| 2015/0262435 | A1 | 9/2015 | Delong et al. |
| 2015/0281450 | A1 | 10/2015 | Shapiro et al. |
| 2015/0302725 | A1 | 10/2015 | Sager et al. |
| 2015/0327039 | A1 | 11/2015 | Jain |
| 2015/0334227 | A1 | 11/2015 | Whitten et al. |
| 2015/0339912 | A1 | 11/2015 | Farrand et al. |
| 2015/0358795 | A1 | 12/2015 | You et al. |
| 2015/0379562 | A1 | 12/2015 | Spievak et al. |
| 2015/0381563 | A1 | 12/2015 | Seo et al. |
| 2016/0006837 | A1 | 1/2016 | Reynolds et al. |
| 2016/0012702 | A1 | 1/2016 | Hart et al. |
| 2016/0036751 | A1 | 2/2016 | Ban |
| 2016/0036962 | A1 | 2/2016 | Rand |
| 2016/0066011 | A1 | 3/2016 | Ro et al. |
| 2016/0078750 | A1 | 3/2016 | King et al. |
| 2016/0117684 | A1 | 4/2016 | Khor et al. |
| 2016/0142758 | A1 | 5/2016 | Karp et al. |
| 2016/0150024 | A1 | 5/2016 | White |
| 2016/0173693 | A1 | 6/2016 | Spievak et al. |
| 2016/0219150 | A1 | 7/2016 | Brown |
| 2016/0248847 | A1 | 8/2016 | Saxena et al. |
| 2016/0269882 | A1 | 9/2016 | Balthasar et al. |
| 2016/0277573 | A1 | 9/2016 | Farrand et al. |
| 2016/0300260 | A1 | 10/2016 | Cigich et al. |
| 2016/0315909 | A1 | 10/2016 | von Gravrock et al. |
| 2016/0323446 | A1 | 11/2016 | Farrand et al. |
| 2016/0330069 | A1* | 11/2016 | Nordmark ..... G08B 25/10 |
| 2016/0330108 | A1 | 11/2016 | Gillon et al. |
| 2016/0330319 | A1 | 11/2016 | Farrand et al. |
| 2016/0330770 | A1 | 11/2016 | Lee et al. |
| 2016/0373372 | A1 | 12/2016 | Gillon et al. |
| 2017/0021802 | A1 | 1/2017 | Mims |
| 2017/0024995 | A1 | 1/2017 | Gu et al. |
| 2017/0034044 | A1 | 2/2017 | Gillon et al. |
| 2017/0034045 | A1 | 2/2017 | Gillon et al. |
| 2017/0034062 | A1 | 2/2017 | Gillon et al. |
| 2017/0034081 | A1 | 2/2017 | Gillon et al. |
| 2017/0084164 | A1 | 3/2017 | Farrand et al. |
| 2017/0104875 | A1 | 4/2017 | Im et al. |
| 2017/0188216 | A1 | 6/2017 | Koskas et al. |
| 2017/0270569 | A1 | 9/2017 | Altberg et al. |
| 2017/0272316 | A1 | 9/2017 | Johnson et al. |
| 2017/0293301 | A1 | 10/2017 | Myslinski |
| 2017/0339228 | A1 | 11/2017 | Azgin et al. |
| 2018/0061213 | A1 | 3/2018 | Morehead |
| 2018/0075540 | A1 | 3/2018 | Bernard et al. |
| 2018/0152557 | A1 | 5/2018 | White et al. |
| 2018/0262441 | A1 | 9/2018 | Gillon et al. |
| 2018/0302334 | A1 | 10/2018 | Osterlund et al. |
| 2018/0324105 | A1 | 11/2018 | Gillon et al. |
| 2018/0375927 | A1 | 12/2018 | Nozawa |
| 2019/0044641 | A1* | 2/2019 | Trundle ..... H04K 3/224 |
| 2019/0045058 | A1 | 2/2019 | Im et al. |
| 2019/0052752 | A1 | 2/2019 | Farrand et al. |
| 2019/0190942 | A1* | 6/2019 | Drummond ..... H04L 43/0847 |
| 2019/0206227 | A1 | 7/2019 | Farrand et al. |
| 2019/0222993 | A1 | 7/2019 | Maheshwari et al. |
| 2019/0385435 | A1 | 12/2019 | Farrand et al. |

FOREIGN PATENT DOCUMENTS

| | | | |
|---|---|---|---|
| EP | 2187574 | A1 | 5/2010 |
| EP | 3050287 | A1 | 8/2016 |
| EP | 3146516 | A1 | 3/2017 |
| EP | 3167340 | A1 | 5/2017 |
| EP | 3295620 | A1 | 3/2018 |
| EP | 3050287 | B1 | 12/2018 |
| EP | 3585011 | A1 | 12/2019 |
| WO | WO2015041738 | A1 | 3/2015 |
| WO | WO2015179120 | A1 | 11/2015 |
| WO | WO2016007244 | A1 | 1/2016 |
| WO | WO2016182796 | A1 | 11/2016 |
| WO | WO2018044657 | A1 | 3/2018 |

OTHER PUBLICATIONS

"International Search Report" and "Written Opinion of the International Searching Authority," Patent Cooperation Treaty Application No. PCT/US2015/029109, dated Jul. 27, 2015, 12 pages.

"International Search Report" and "Written Opinion of the International Searching Authority," Patent Cooperation Treaty Application No. PCT/US2015/034054, dated Nov. 2, 2015, 15 pages.

Life Alert. "Life Alert's Four Layers of Protection, First Layer of Protection: Protection at Home." https://web.archive.org/web/20121127094247/http://www.lifealert.net/products/homeprotection.html. [retrieved Oct. 13, 2015], 4 pages.

"International Search Report" and "Written Opinion of the International Searching Authority," Patent Cooperation Treaty Application No. PCT/US2016/030597, dated Jun. 30, 2016, 12 pages.

"Extended European Search Report," European Patent Application No. 14845956.3, dated Feb. 16, 2017, 8 pages.

"Office Action," Canadian Patent Application No. 2949211, dated Aug. 16, 2017, 4 pages.

"Office Action," Canadian Patent Application No. 2954351, dated Oct. 27, 2017, 3 pages.

"International Search Report" and "Written Opinion of the International Searching Authority," Patent Cooperation Treaty Application No. PCT/US2017/048284, dated Nov. 8, 2017, 8 pages.

"Extended European Search Report," European Patent Application No. 15796148.3, dated Jan. 8, 2018, 8 pages.

"Office Action," European Patent Application No. 14845956.3, dated Apr. 9, 2018, 4 pages.

"Extended European Search Report," European Patent Application No. 15818258.4, dated Feb. 26, 2018, 8 pages.

"Notice of Allowance," European Patent Application No. 14845956.3, dated Jul. 11, 2018, 7 pages.

"Notice of Allowance", Canadian Patent Application No. 2949211, dated Jul. 31, 2018, 1 page.

"Office Action," Canadian Patent Application No. 2954351, dated Aug. 22, 2018, 4 pages.

"Partial Supplementary European Search Report," European Patent Application No. 16793194.8, dated Nov. 19, 2018, 10 pages.

"Extended European Search Report," European Patent Application No. 19187593.9, dated Nov. 13, 2019, 8 pages.

Takahashi et al. "A Hybrid FEC Method Using Packet-Level Convolution and Reed-Solomon Codes," IEICE Transaction on Communications, Communications Society, vol. E89-B, No. 8, Aug. 1, 2006. pp. 2143-2151.

"Extended European Search Report," European Patent Application No. 16793194.8, dated Feb. 26, 2019, 9 pages.

"Notice of Allowance", Canadian Patent Application No. 2954351, dated Aug. 27, 2019, 1 page.

"Office Action," European Patent Application No. 15796148.3, dated Jan. 29, 2020, 6 pages.

"Office Action," European Patent Application No. 15818258.4, dated Jan. 31, 2020, 5 pages.

* cited by examiner

NETWORK JAMMING DETECTION AND REMEDIATION

CROSS REFERENCE TO RELATED APPLICATIONS

This application is a continuation-in-part of U.S. patent application Ser. No. 15/369,655, filed Dec. 5, 2016 and issued Apr. 9, 2019 as U.S. Pat. No. 10,255,792, which is a continuation of U.S. patent application Ser. No. 14/283,132, filed May 20, 2014 and issued Apr. 25, 2017 as U.S. Pat. No. 9,633,547, the disclosures of which are incorporated by reference for all purposes.

FIELD OF THE INVENTION

The present technology pertains to telecommunications networks and more specifically to network jamming detection and remediation.

BACKGROUND ART

The approaches described in this section could be pursued but are not necessarily approaches that have previously been conceived or pursued. Therefore, unless otherwise indicated, it should not be assumed that any of the approaches described in this section qualify as prior art merely by virtue of their inclusion in this section.

Communications networks can include a collection of nodes where transmission links are connected so as to enable communication between the nodes. The transmission links connect the nodes together. The nodes use circuit switching, message switching, or packet switching to pass the signal through the correct links and nodes to reach the correct destination terminal. Each node in the network usually has a unique address so messages or connections can be routed to the correct recipients. The collection of addresses in the network is called the address space.

SUMMARY OF THE INVENTION

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

The present disclosure is related to various systems and methods for network jamming detection and remediation. Specifically, a method for may comprise: detecting by a base unit network jamming, the base unit being disposed in a residence. Some embodiments may further include: issuing an alert in response to the detected network jamming, the alert being last least one of: sounding an audible alarm, showing a visual alarm indication, communicating with law enforcement, and communicating with an alarm monitoring station.

BRIEF DESCRIPTION OF THE DRAWINGS

Embodiments are illustrated by way of example, and not by limitation, in the figures of the accompanying drawings, in which like references indicate similar elements and in which.

DETAILED DESCRIPTION

Figure 1:
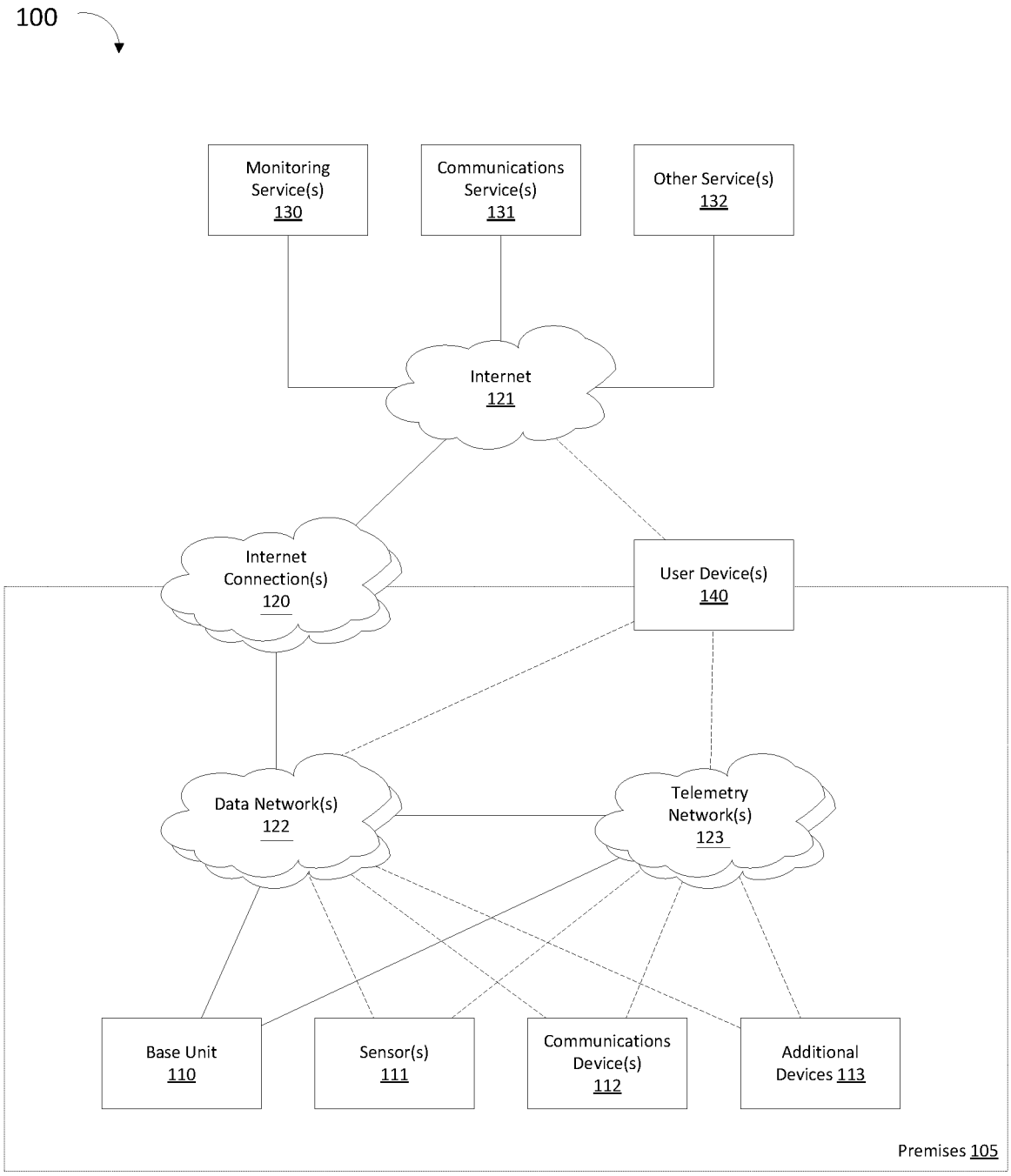
FIG. 1 is a simplified block diagram of a network, according to some embodiments.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Network Environment

FIG. 1 shows network system 100, which can be deployed in (or near) a Premises 105, for example small office and/or a home, along with connections to the outside world. As shown in FIG. 1, Base Unit 110 operates as a primary (although not exclusive) device providing services, including security services.

In some embodiments, Base Unit 110 monitors various Sensor(s) 111 which are able to monitor conditions in and around Premises 105. Sensors may include but are not limited to security sensors, for example motion sensors, window and door sensors, pressure sensors, temperature sensors, heat sensors, smoke/CO detectors, glass break sensors, and the like. Security sensors are typically (although may not be exclusively) intended to be used to provide information about security for a premises, for example sensors connected to an alarm system or providing other security capabilities. Sensors may also include sensors embedded in other devices, for example motion sensors embedded in a thermostat, microphones in a television or consumer electronics device, and the like, even if these were not purpose-built for this role. That is, the sensor in a thermostat may have been intended to monitor for occupancy and to adjust the temperature accordingly, but may be monitored by Base Unit 110 for the purpose of intruder detection.

Additionally, Base Unit 110 may be used to enable communications services for users in Premises 105. Example communications services include telephony services, but could also include other communications mechanisms such as video, short message services, instant messaging, etc. A number of Communications Device(s) 112 work in cooperation with the Base Unit 110 to enable these services. Communications Device(s) 112 may include wired or wireless telephone handsets, video units, speakerphones, fax machines, etc.

Additional Device(s) 113 may also be deployed around Premises 105. Additional devices may be any device which does not fall into the categories of Base Unit 110, Communications Device 112, or Sensor(s) 111. For example, this may include other devices which are connected to a home network and may therefore observe behavior of the network, but are not being explicitly used as a sensor. Examples could include network infrastructure other than the Base Unit 110 (e.g., routers, switches, firewalls, access points, etc.), consumer electronic devices, gaming devices, smart home devices, etc.

Base Unit 110, Sensor(s) 111, Communications Device(s) 112, and Additional Device(s) 113 can interact with each other, as well as services, devices, and users both inside and outside Premises 105. Several networks can be used to enable these interactions.

Premises 105 can be equipped with one or more Internet Connection(s) 120. Internet Connection(s) allows devices (e.g., Base Unit 110, Sensor(s) 111, Communications Device(s) 112, and/or Additional Device(s) 113) to optionally communicate with the outside world, by providing access to the Internet 121. Internet Connection(s) logically include both the hardware and services needed to enable connection to the Internet 121. For example, this may consist of a cable modem, the cable connecting Premises to the cable operator's (as Internet service provider) network, and the services and infrastructure of the cable operator allowing access to the Internet 121. In many cases, Premises 105 may have more than one Internet Connection(s) 120, for example a primary cable data connection (e.g., cable internet service, Digital Subscriber Line (DSL), and the like), and a secondary network connection (e.g., WiMAX, LTE broad area wireless connection, and the like).

One or more Data Network(s) 122 can be deployed in and/or near Premises 105, and are also connected to Internet Connection(s) 120. Base Unit 110, and optionally other devices (e.g., Sensor(s) 111, Communications Device(s) 112, and/or Additional Device(s) 113) can be connected to Data Network(s) 122, both as a mechanism to communicate with one another, as well as to access Internet 121. Examples of Data Network(s) 122 include a wireless network (i.e., Wi-Fi) within Premises 105, and/or a wired Ethernet network within Premises 105.

Additionally, one or more Telemetry Network(s) 123 can be deployed on Premises 105. Telemetry Network(s) 123 is designed to provide interconnection between the Base Unit and optionally various devices (e.g., Sensor(s) 111, Communications Device(s) 112, and/or Additional Device(s) 113) within Premises 105. Generally, Telemetry Network(s) 123 is not directly connected to the Internet 121, but devices may communicate externally if messages are translated or relayed to Data Network(s) 122 and on to the Internet 121 via Internet Connection(s) 120. For example, devices may connect to Base Unit 110 via Telemetry Network(s) 123, and information may then be relayed over the Internet 121. Examples of typical networking technologies used for Telemetry Network(s) 123 include Bluetooth, Bluetooth Low Energy, DECT, ZWave, and Zigbee. In some cases, a networking technology more often used for a Data Network(s) 122 (e.g., Wi-Fi) may be used for Telemetry Network(s) 123. For example, a second, internal Wi-Fi network (without external connectivity) could be set up for use as Telemetry Network(s) 123.

Base Unit 110 and optionally other devices (e.g., Sensor(s) 111, Communications Device(s) 112, and/or Additional Device(s) 113) communicate with external entities reached over the Internet 121. For example, to implement a security system, one or more Monitoring Service(s) 130 may be utilized. Monitoring Service(s) 130 monitor the status of the devices within Premises 105 and are able to respond to security alerts. For example, an alarm condition triggered by one or more Sensor(s) 111 (with messages potentially relayed by Base Unit 110) may be observed by Monitoring Service(s) 130. Monitoring Service(s) 130 can then take appropriate/responsive actions, for example alerting authorities, contacting the user of the system to confirm the threat, etc.

In various embodiments, communications services are offered to the end user devices. In this case, the devices (e.g., Base Unit 110, Sensor(s) 111, Communications Device(s) 112, and/or Additional Device(s) 113) may communicate over the Internet 121 with one or more Communications Service(s) 131 to facilitate the communications. This can include locating and establishing communications with other users, or connecting to telephony services (e.g. Plain Old Telephone Service (POTS)).

Other Services 132, which can provide services other than security monitoring and communications, may also be used by devices on Premises 105 (e.g., Base Unit 110, Sensor(s) 111, Communications Device(s) 112, and/or Additional Device(s) 113). For example media streaming services, intelligent assistant services, and other capabilities may be used by or have information provided by devices on Premises 105.

An end user, for example the owner or another occupant of Premises 105, may have User Device 140 connected to one or more networks (e.g., Data Network(s) 122, Telemetry Network 123, and/or Internet 121). Examples of User Device 140 include a smart phone, a tablet, software running on a personal computer, a smart watch, etc. User Device 140 allows access to and control of devices within Premises 105 (e.g., Base Unit 110, Sensor(s) 111, Communications Device(s) 112, and/or Additional Device(s) 113). Additionally, devices within Premises 105 may send information and notifications to User Device 140. User Device 140 may also communicate with the external services (e.g., Monitoring Service(s) 130, Communications Service(s) 131, and/or Other Service(s) 132). At various times, User Device 140 may be located on Premises 105 (e.g., while the user is physically at Premises 105, or located outside of Premises 105. When located at Premises 105, and depending on the networking capabilities available, optionally one or more of Data Network(s) 122 and Telemetry Network(s) 123 may be used to communicate. When located off Premises 105, optionally various connectivity mechanisms may be used to reach Internet 121, allowing connectivity.

Figure 2:
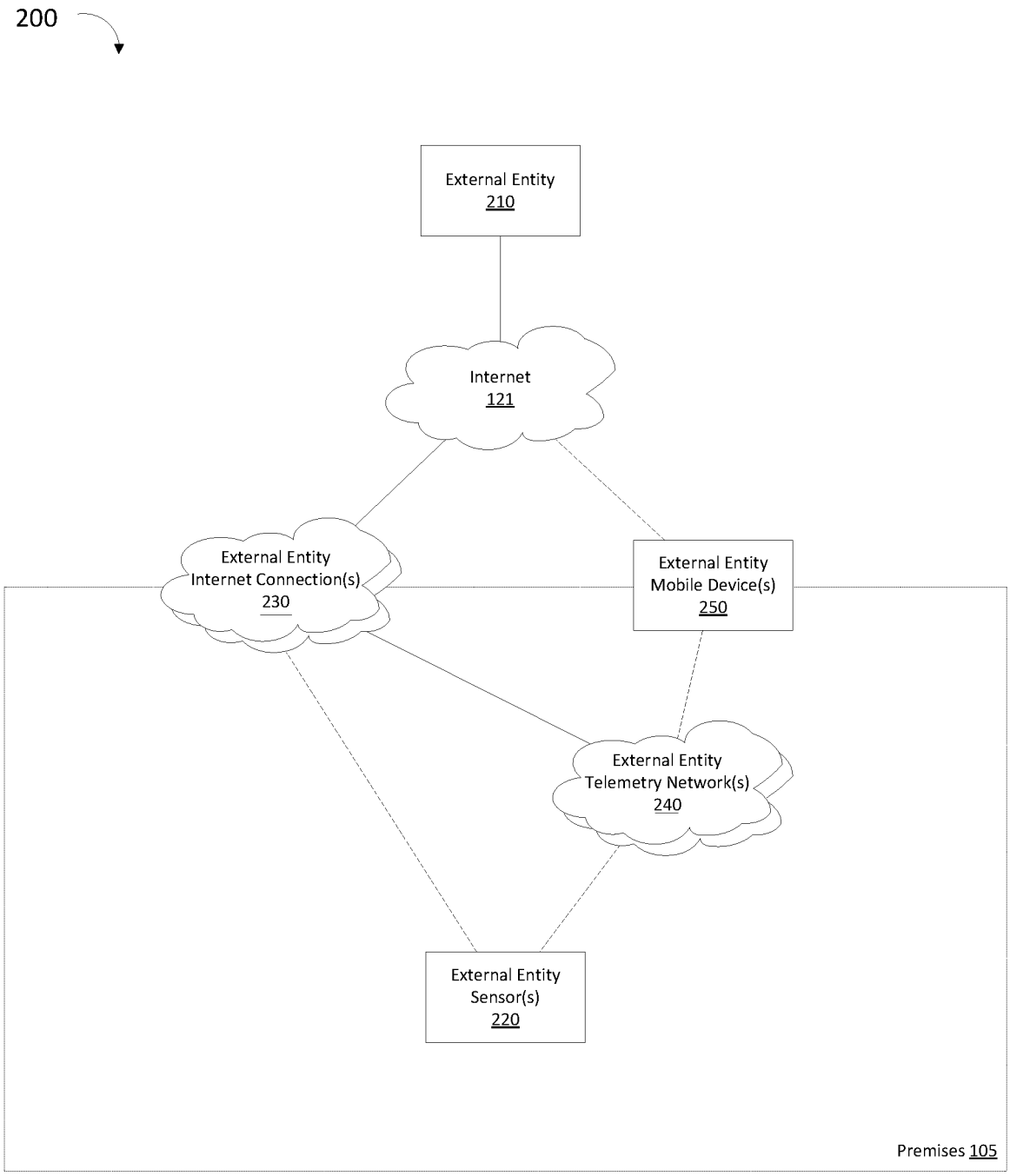
FIG. 2 is a simplified block diagram of a network, according to various embodiments.

FIG. 2 illustrates network 200 according to some embodiments. Here, External Entity 210 has deployed one or more External Entity Sensors(s) 220 on Premises 105. External Entity Sensors(s) 220 can be outside the control of the occupants of the Premises. For example, External Entity Sensors(s) 220 is a smart utility meter (e.g., electricity, water, gas, and the like), and the External Entity is a utility company.

External Entity Sensor(s) 220 can be connected to and/or incorporate one or more network connections, separate from the networks operated by the resident/occupant of Premises 105. In some embodiments, External Entity Sensor(s) 220 are connected to the Internet 121 via an External Entity Internet Connection(s) 230, for example a cellular or WiMax connection. This allows External Entity Sensor(s) 220 to send information back to External Entity, for example meter readings. In another embodiment, External Entity Sensor(s) 220 is connected to an External Entity Telemetry Network(s) 240. External Entity Telemetry Network(s) 240 may itself connect to External Entity Internet Connection 230 to send data to the External Entity 210, or, an individual associated with External Entity may come to or near the Premises and connect to the External Entity Telemetry Network(s) 240 using an External Entity Mobile Device(s) 250 to contact External Entity Sensor(s) 220. In one embodiment, External Entity Mobile Device(s) 250 is a meter reading device. In various embodiments, External Entity Sensor(s) 220 can use the consumer's (e.g., resident/occupant of Premises 105) network to connect.

Detection Overview

Various mechanisms can be used by various devices within the Premises 105 to detect when jamming has either occurred or been attempted. This detection may be performed by the Base Unit 110, or one of the other devices, for example Sensor(s) 111, Communications Device(s) 112, and/or Additional Device(s) 113. Various actions may be taken in response to detecting of jamming behavior, as described below.

As used herein, "jamming" in broad terms is attempting to interfere with normal and proper communications between the various devices (e.g., Base Unit 110, Sensor(s) 111, Communications Device(s) 112, and/or Additional Device(s) 113) in Premises 105; between these devices and external services (e.g., Monitoring Service(s) 130, Communications Service(s) 131, and/or Other Service(s) 132); and/or between these devices and other entities reached over Internet 121.

By way of example, for a security system, the jamming would have the function of allowing an intruder into Premises 105 to enter and/or move about Premises 105 undetected and/or without issuing an alarm. By way further non-limiting example of a security alarm, positional information may be jammed, resulting in an inability to detect (or spoofing of) devices that have entered/exited the premises (geofencing), often used to arm or disarm systems, track intruders, etc.

Jamming may also be used as an active tool, with the attacker actively attempting to cause the alarm to sound. In such a case, law enforcement such as the police may respond. If this is combined with a call to police claiming an attacker is in the premises (e.g., "SWATing"), it may create a dangerous situation for the building occupants. A system that is able to recognize a jam condition (as opposed to an actual sensor trip, for example from a window being broken or a door opened) is advantageous.

According to various embodiments, an External Entity 210 wishes to detect jamming or tampering with their External Entity Internet Connection(s) and/or External Entity Telemetry Network(s) 240, to prevent falsification of sensor data (e.g., to prevent meter fraud). Detecting jamming by an outside intruder and preventing tampering of monitoring signals by the resident of Premises 105 are described below.

Loss of Network Connectivity

Detection of loss of access to one or more of the networks or connections can be used to detect jamming. For example, even if other mechanisms indicate failure, loss of connectivity to Telemetry Network(s) 123 and/or to Data Network(s) 122 (e.g., External Entity Telemetry Network(s) 240 or External Entity Internet Connection(s) 230 in the External Entity scenario) is an indication that jamming may be occurring. This loss may be at a very low level (e.g., loss of physical/electrical connection, loss of carrier, and the like), higher level (e.g., network appears functional but no traffic is seen and no responses to queries is returned), or in the form of garbled or incorrect data. This may be the result of something as simple as cutting cables; unplugging access points; unplugging switches, routers, bridges, hubs, etc.; removing antennas; wrapping antennas in opaque materials or otherwise obstructing signal paths; etc.

Loss of Internet Connection(s) 120 may be an indication of jamming. In this case, devices (e.g., Base Unit 110, Sensor(s) 111, Communications Device(s) 112, and/or Additional Device(s) 113; or External Entity Sensor(s) 220 in the External Entity scenario) may be able to fully communicate with one another, but will have no access to external services (e.g., Monitoring Service(s) 130, Communications Service(s) 131, and/or Other Service(s) 132 (e.g., External Entity 210 and/or External Entity Mobile Device(s) 250 in the External Entity Scenario)) and/or to other entities on the Internet 121. This may be detected with tests such as attempting to reach a number of locations off the Premises 105 and determining all are unreachable. Again, such jamming may be achieved by an intruder in a number of ways analogous to those discussed above.

Many other failures that are not in fact jamming may also result on the observed behavior of network connection failure. This includes failures of physical connections (e.g., severing of cables); failure of equipment within the premises, the service provider, or the Internet; interference from other sources (e.g., a microwave oven interfering with a WiFi connection), etc.

Detect Full Power

In some embodiments, detection of jamming is performed by observing power levels on wireless frequencies used to communicate information over either Data Network(s) 122 and/or Telemetry Network(s) 123. Measurement can occur of these power levels over a variable, user-defined, and/or pre-determined interval. In the External Entity scenario, this same mechanism may be used to detect jamming on External Telemetry Network(s) 240 and/or External Entity Internet Connection(s) 230.

Many network protocols utilize short intervals, commonly referred to as the slot time, which are used as part of the algorithm when detecting if the shared wireless media is busy, noisy, etc. The process of measuring for signals over a multiple of this interval, specifically to detect if other devices are attempting to transmit, is referred to as carrier sense (CS) mechanism. If the spectrum is free for a particular multiple of these slots, plus a constant for process time, the channel is deemed to be available for transmission. The multiple may vary depending on the underlying network technology. For example, for 802.11 WiFi, 2*slot time is used. Similarly, the slot time itself varies depending on the technology used, the transmission speed of the network, and other factors. For example, for 802.11a WiFi 9 microseconds is used.

In addition or alternative to using the measurement of energy during the slot time to sense when the network is available, the same measurements can be used by Energy Detection (ED) algorithms to monitor for any noise or other energy which could disrupt the signal. If there is too much noise, that is, too much energy in the same spectrum used by the transmission, the wireless protocol will determine that effective transmission is not possible, and the connection will not be operational.

For the majority of cases where abnormal interference is not present, the energy detection algorithm can determine that the noise level is sufficiently low to allow for adequate data transmission, and normal communication can commence. The energy levels of the shared spectrum can continue to be measured at regular intervals as part of the carrier sense mechanism.

Figure 3:
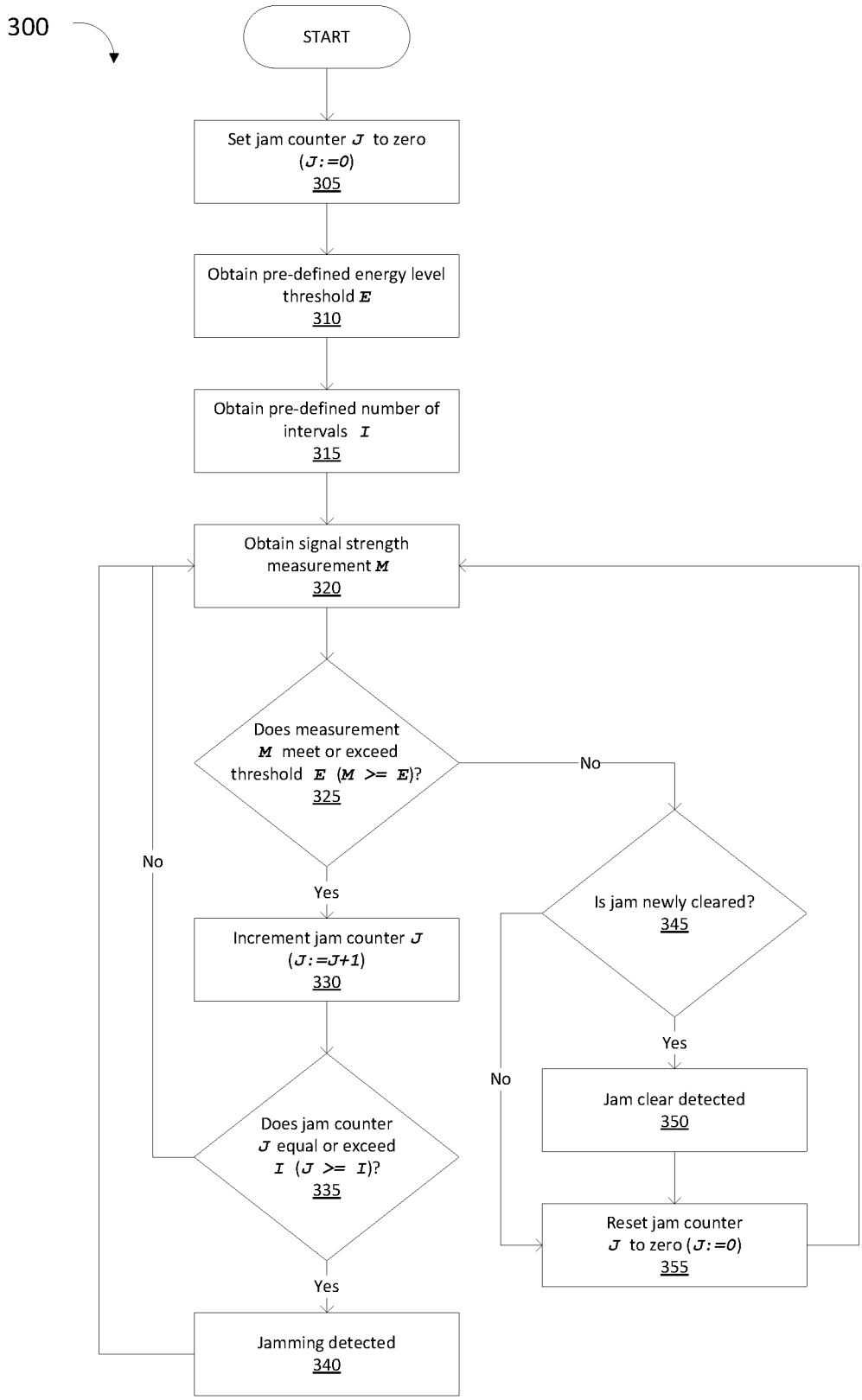
FIG. 3 is a simplified block diagram of a method for detecting jamming, in accordance with some embodiments.

FIG. 3 illustrates method 300 for detecting jamming based on the measured energy level over a pre-defined interval, typically an integer multiple number of slot times. If the energy level is determined to be above a particular pre-defined threshold for greater than the pre-defined number of slot times, the connection can be deemed to be jammed. Method 300 can commence at start, then move to step 305 where a jam counter, J is set to zero (J:=0). Method 300 can proceed to step 310.

At step 310 the system can be queried to obtain a pre-defined signal (energy) threshold E. This level E may be the maximum level readable from the system, or may be a particular pre-defined (typically high) level of signal. Method 300 can proceed to step 315 where the analogous pre-defined integer multiple I of time intervals is obtained. This interval is used, in combination with the pre-defined signal threshold E from step 310 to determine that the signal is being jammed. In other words, if the measured signal level exceeds E for I or more time intervals, jamming will be indicated. After obtaining pre-defined values E and I, Method 300 can proceed to step 320.

At step 320, a signal strength measurement M can be obtained. Signal strength measurement M may be taken instantaneously, or over an interval, for example the slot time. Signal strength measurement M can be taken over one or more frequencies relevant to the wireless network monitored for jamming. Signal strength measurement M may be taken over one or more frequencies, over different frequencies (e.g., one randomly selected channel for each measurement), over a selected frequency as a representative frequency, etc. Measurements may be independent of each other, or may be weighted with previous measurements to obtain a sliding/moving/rolling/running average. In this way, brief pauses in signal jamming may still result in jamming being recognized.

Once the most recent measurement M has been obtained, method 300 can proceed to step 325 where the measurement M is compared to pre-defined energy threshold E. If the measurement M equals or exceeds threshold E (M>=E) at step 325, method 300 can proceed to step 330, where jam counter J is incremented (J:=J+1). Note that J represents the number of sequential measurement intervals for which M has exceeded E. Method 300 can proceed to step 335.

At step 335 it can be determined if the value of J (the number of intervals where measurement M has exceeded E) has reached or exceeded I. If J>=I, this indicates that the measured signal strength M has exceeded the predefined signal strength E for at least I intervals, and that jamming is detected, and method 300 can proceed to step 340 where the jam is detected. This may involve setting a flag or variable, sending a signal to an appropriate software process or hardware device, etc., and actions are taken as discussed later. This action may optionally be taken each time J increases, or only the first time that J equals or exceeds I. After detecting the jam at step 340, method 300 can return to step 320, where the next measurement M is taken.

If at step 325 signal level measurement M does not exceed E (e.g., M<E), method 300 can proceed to step 345, where it is determined if the jam has (just) been resolved. That is, if a jam has been detected immediately previously to this point. If so, method 300 can proceed to step 350, where jam clear is detected. Analogously to step 340, flags or variables may be set, or signals sent to appropriate software process or hardware devices to take action at the resolution of the jam (again, actions taken are discussed later), and again may be taken the first time M<E or each time. Method 300 can continue to step 355, where jam counter J is reset to zero (J:=0).

If it was determined at step 345 that a jam has not recently been cleared (e.g., no jam was previous occurring), method 300 can proceed to step 355, where jam counter J is reset to zero (J:=0). Following step 355, method 300 can proceed to step 320, where the next measurement M is taken.

Since measurement M taken at step 320 may be weighted or averaged using a moving average, intermittent or periodic jamming may still cause measurement M to remain above E, even when one or more raw measurements drops below E.

Obtaining Energy Level Information

Measurements M may be obtained in a number of ways, and in a number of places within system 100. Measurements may be taken by the Base Unit 110, or any of the other devices (e.g., Sensor(s) 111, Communications Device(s) 112, and/or Additional Devices 113), so long as the device is equipped with a radio capable of obtaining measurements of energy levels within the desired frequency or range of frequencies. Note also that various devices may monitor different frequencies, for example the Base Unit 110 may be monitoring WiFi, Bluetooth, and/or DECT for jamming, if equipped with all of these radios, and another device, for example a remote security sensor (e.g., an instance of Sensor(s) 111) may only be equipped with a DECT radio, and therefore only monitor related frequencies.

In the External Entity scenario, these measurements may be taken by External Entity Sensor(s) 220, by External Entity Mobile Device(s) 250, by equipment related to External Entity Internet Connection(s) 230, and/or by dedicated sensors attached to these networks.

Chipset, Driver, Software

Measurements are obtained by communicating with underlying hardware components/devices (e.g., radio system) and obtaining measurements from the software used to control and/or interface with the appropriate hardware, for example through a device driver, API, or similar software exposing functionality on the underlying hardware. For example, this information is obtained by explicitly requesting it from the underlying hardware. By way of further non-limiting example, the measurements are available in variables or similar locations, and may be queried by the system. By way of further non-limiting example, callback functions or similar mechanisms are exposed by the API, allowing the system to be notified when a new measurement or an abnormal measurement is available. These measurements may then be used in method 300 (e.g., evaluated and acted upon) as described above.

Tool

Specially designed monitoring software, for example Airshark from the University of Wisconsin can be used to monitor a wireless environment. This software allows control of the underlying hardware associated with various wireless network interface devices, and the use of that hardware to measure signal strengths for the frequencies that hardware is capable of measuring. These measurements may then be used in method 300 as described above.

Special Hardware/Software Signal

The underlying hardware can provide an explicit mechanism to signal software (or other hardware devices, which may then signal software) when the radio spectrum used is not available, such as when a transmission is in progress and the energy level on the desired frequency is too high. For example, the underlying WiFi controller may set a light, power a connection, etc., to indicate that it is unable to obtain access to a frequency, because the frequency is in use. Here, software can measure this hardware signal and provides the information to the system. These measurements may then be used in method 300 as described above. A software signal or indication can be used to determine that the underlying hardware has detected that the spectrum is unavailable.

Separate Jam Detector

According to some embodiments, a freestanding device can monitor and detect that the spectrum needed is in use (e.g., that a transmission is already using the frequency) over a given interval, and this information is reported to and/or queried by the algorithm to use as readings.

Corrupted Messages

According to various embodiments, the system monitors messages and notices when messages from one or more other devices suddenly becomes garbled or corrupted. A pre-defined threshold can be used to determine if message corruption is indicative of jamming. The pre-defined threshold may be a specified percentage of messages, bytes, segments, etc., over a given time being corrupted; a specified percentage of messages, bytes, segments, etc., over a given number of messages, bytes, segments, etc. being corrupted; a specified number of messages, bytes, segments, etc. being corrupted within a certain time; a specified increase in the rate or percentage of messages, bytes, segments, etc. (over time or over a certain number of messages, bytes, segments, etc.); and the like.

Figure 4:
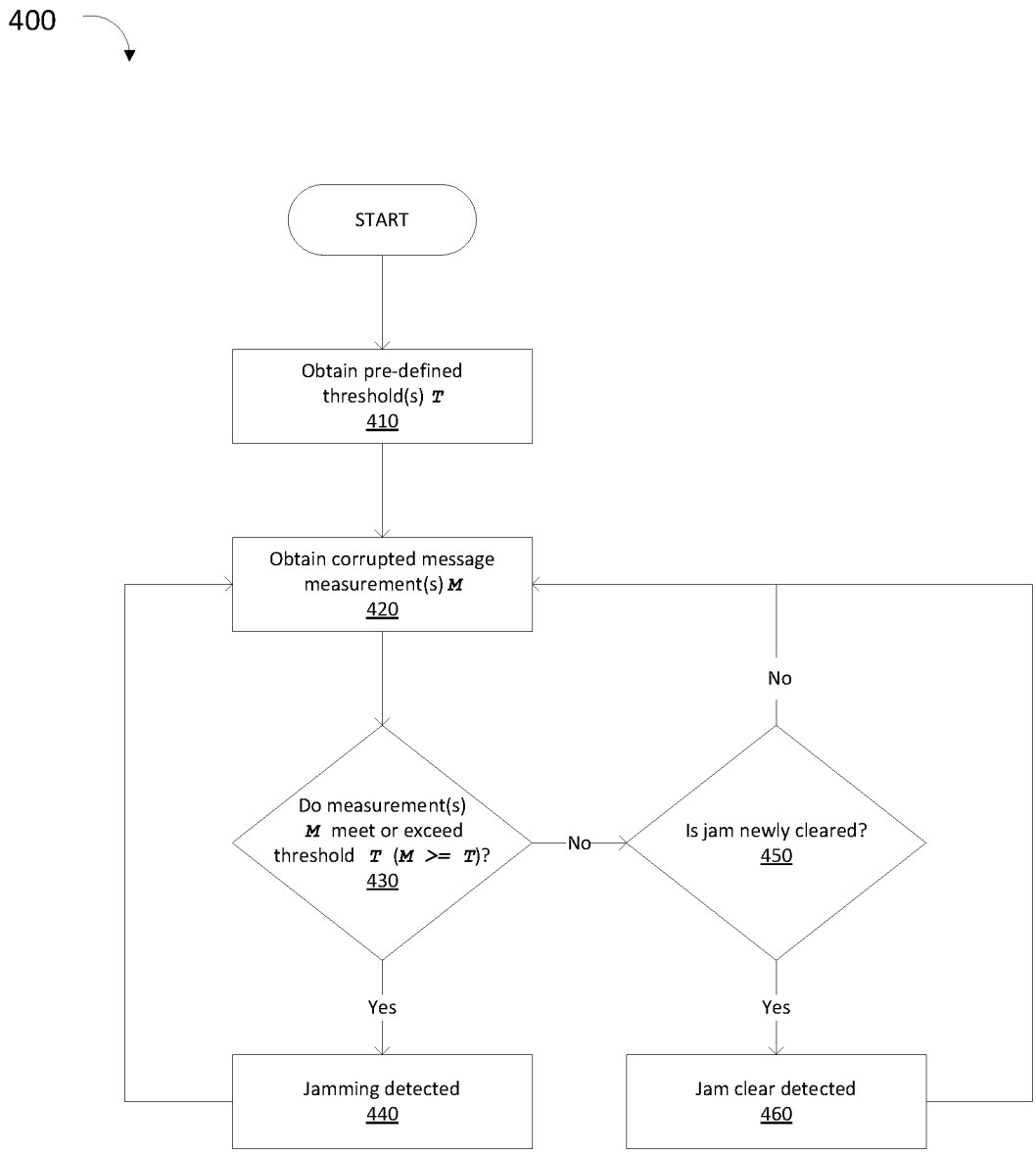
FIG. 4 is a simplified block diagram of a method for detecting garbled and/or corrupted messages, in accordance with various embodiments.

FIG. 4 illustrates method 400 for detecting garbled and/or corrupted messages. At step 410 the predefined threshold or threshold(s) T used to detect that corrupted messages are jamming is obtained, and method 400 proceeds to step 420.

At step 420 one or more corrupted message measurements M (e.g., rates of loss, percentages of loss, etc., as described above) are obtained. Method 400 proceeds to step 430.

At step 430, measurement(s) M can be compared against the appropriate threshold(s) T. If any measurements exceed their corresponding thresholds, method 400 proceeds to step 440. If not, method 400 proceeds to step 450. Multiple comparisons, using multiple measurements and thresholds, may be made at step 430. For example, a comparison may be made between a percentage of bytes corrupted over the last second and the corresponding threshold, and between a number of segments corrupted out of the last 10 and a corresponding threshold. When particular combinations and/or permutations of these comparisons result in the measurement exceeding the threshold, method 400 proceeds to step 440. In other words, method 400 may designate more than one to metric to indicate jamming.

At step 440, jamming can be detected. Upon detection of jamming, a flag or variable may be set, a signal to an appropriate software process or hardware device may be sent, and the like, and actions are taken as described below. Such actions may optionally be taken each time measurements M exceed the threshold T, only the first time, etc. After detecting the jam at step 440, method 400 returns to step 420, where the next measurement(s) M can be taken.

If at step 430 no measurements M exceed any thresholds T, method 400 proceeds to step 450, where it is determined if the jam has just been resolved. That is, if a jam has been detected immediately previously to this point. If so, method 400 proceeds to step 460, where jam clear is detected. Analogous to step 440, flags or variables may be set, or signals sent to appropriate software process or hardware devices to take action at the resolution of the jam (again, actions taken are described below), and again may be taken the first time M<E or each time M<E. After determining that a jam has cleared at step 460, method 400 returns to step 420, where the next measurement(s) M can be taken.

If it was determined at step 450 that a jam has not recently cleared (e.g., no jam was previous occurring), method 400 returns to step 420, where the next measurement(s) M can be taken.

Other conditions, for example low batteries in devices or interference may also cause the messages to be corrupted, and additional mechanisms to filter for these conditions may be used.

Cryptographic Errors/Impersonation Mechanism

According to various embodiments, messages between devices in the system (e.g., Base Unit 110, Sensor(s) 111, Communications Device(s) 112, and/or Additional Device(s) 113) or between devices and User Device(s) 140 and/or services (e.g. Monitoring Service(s) 130, Communications Service(s) 131, and/or Other Service(s) 132) are monitored to observe encryption and/or authentication credentials. If messages are between the device(s) or service(s) with incorrect cryptographic properties (e.g., messages that are authenticated, signed, or encrypted improperly; and/or are not authenticated, signed, or encrypted when they are expected to be), this can be interpreted as evidence of jamming. When jamming is detected, the system is notified. This may involve setting a flag or variable, sending a signal to an appropriate software process or hardware device, etc., and actions are taken as described below.

In the External Entity scenario, External Entity Sensor(s) 220 may detect this directly (e.g., by seeing spoofed sensor data), the detection may occur at the External Entity 210 (e.g., by observing forged sensor data), or by External Entity Mobile Device(s) 250.

Beacon Pulse Change Detection

In some embodiments, protocols using beacon pulses (e.g., DECT, Bluetooth Low Energy (BLE), and the like) are monitored for abnormal beacon behavior to detect jamming. These types of networks may typically be an example of Telemetry Network(s) 123.

In various embodiments, Base Unit 110, or another device (e.g., Sensor(s) 111, Communications Device(s) 112, and/or Additional Device(s) 113) serve as the master or base station. Periodically, the master or base station sends a beacon pulse out to all connected devices. If the master or base station detects that another device has sent a beacon pulse of its own (e.g., for the same network) just prior to the time the master would normally send the pulse, this may indicate that another device is attempting to impersonate the master or base station, and therefore control the network. This is interpreted as evidence of jamming. The message may appear to be a corrupted message from the master or base station. When jamming is detected, the system is notified. This may involve setting a flag or variable, sending a signal to an appropriate software process or hardware device, etc., and actions are taken as described below. In some network protocols, such a jamming attack does not need security credentials, for example a system shared secret (e.g., a password and/or security certificate used for authentication of (all) devices and can be at least one of preconfigured/preinstalled, automatically configured/downloaded, and manually configured/downloaded), to work. Such a jamming attack can be interfering with the connection to all devices over the Telemetry Network(s) 123.

In various embodiments, one or more remote devices (e.g., Sensor(s) 111, Communications Device(s) 112, and/or Additional Device(s) 113) detect an incorrect base unit beacon pulse, and again interprets this pulse as a jamming attempt, as above.

According to some embodiments, rather than detecting a beacon pulse being transmitted immediately before the correct base pulse, a beacon pulse with a mangled (erroneous) ID is sent at the same time as the original beacon pulse, triggering the remote devices to resend (and resynchronize) using this mangled ID. The base unit and/or the remote units may detect this behavior and interpret it as jamming. When jamming is detected, the system is notified. This may involve setting a flag or variable, sending a signal to an appropriate software process or hardware device, etc., and actions are taken as described below.

In the External Entity scenario, these attacks may be detected by any device on External Entity Telemetry Network, e.g., External Entity Sensor(s) 220, External Entity Mobile Device(s) 250, or another device on that network (not shown).

Sequence Number Attack

In some embodiments, the detection system looks for devices attempting to deliberately jam, or to spoof links between devices by manipulating sequence numbers used by protocols, particularly connection-oriented or stream-oriented protocols. These sequence numbers are used by the protocols to ensure that packets are not lost, and that they are returned to the application in order for proper reassembly of the original message. Sequence numbers may be used at various levels in the protocol stack, including at lower levels to manage delivery of packets themselves, or at higher levels to ensure in-order delivery and to verify all packets have been received, particularly when running over lower level protocols that do not provide in-order assembly (e.g., by streaming protocols run over unreliable transports such as UDP).

In some protocols, such as Transmission Control Protocol (TCP), if multiple packets arrive with sequence numbers that are badly out of order, then one side may close the connection, deciding that the packet sequence has become too corrupt to recover. Attackers may use this approach to attempt to drop connections between devices. Similarly, creation of packets (e.g., TCP reset (RST) packets) with spoofed sequence numbers may be used by attackers to force connections to close. Both can have the effect of jamming the connection between devices by forcing the link to close. By watching either for a number of packets with bad sequence numbers, or by observing bad packets with slightly wrong sequence numbers, these attacks may be detected as a form of jamming.

Attack to Force Connection to Close

In various embodiments, a jamming device sends multiple packets for the targeted connection with deliberately incorrect sequence numbers, with the goal of causing the remote party to close the connection. Here, the detecting device (e.g., one or more of Base Unit 110, Sensor(s) 111, Communications Device(s) 112, and/or Additional Device(s) 113) observes that the sequences number on a particular connection are either arriving dramatically out of order or seem to have no resemblance to the original sequence number pattern. If one side of the connection in question is a security sensor, for example, this attack can result in the connection between the security sensor and the base unit being closed, and further messages from the security sensor (including alarm conditions) being ignored. This observation does not have to be for a connection (packet stream) which the observing device is a part of; the observing device may notice out of order sequence numbers on any unencrypted connection the observing device can observe.

Several pre-defined metrics may be used to determine that this sort of attack is being mounted. According to some embodiments, if a pre-determined number of packets have sequence numbers that differ from the expected sequence numbers (e.g., the numbers expected for the current in-flight window) by more than pre-determined number, a jam is indicated. For example, if 10 or more packets are observed with sequence numbers differing by 100 or more from the expected sequence numbers, the connection is marked as jammed. According to various embodiments, this approach is used, but with a provision for a single "outlier" packet number that could be missing or corrupted on one part. In some embodiments, seeing a single sequence number repeated more than a pre-determined (large) number of times indicates that an attack is being mounted. In various embodiments, seeing more than a pre-determined number of packets with sequence numbers that differ by more than a reasonable in flight window size is used as an indication of jamming. For example, if a particular network is unlikely to have packets in flight with sequence numbers that differ by more than 1000, seeing some number (e.g., 3) that differ by more than 1000 is interpreted as jamming.

As with some of the mechanisms described earlier, other failures that are not in fact jamming may also result on the observed behavior of network connection failure. This includes equipment failure, software failures, interference from other sources (e.g., a microwave oven interfering with a WiFi connection), etc.

When jamming is detected, action can be taken by the detecting device. This may involve setting a flag or variable, sending a signal to an appropriate software process or hardware device, etc., and actions are taken as described below.

In the External Entity scenario, these attacks may be detected by any device on External Entity Telemetry Network, e.g., External Entity Sensor(s) 220, External Entity Mobile Device(s) 250, or another device on that network (not shown).

Incorrect Sequence Numbers

In some embodiments, a jamming device attempts to spoof the remote connection and send information from a remote device (e.g., one or more of Base Unit 110, Sensor(s) 111, Communications Device(s) 112, and/or Additional Device(s) 113) to make it appear as if it is the remote device. This could either be on an unencrypted connection, or on an encrypted connection for which credentials have been compromised. If the attacker correctly identifies the sequence numbers, it can insert traffic, sending erroneous messages, or move the message window ahead, causing later messages from the actual attacked device to be incorrectly interpreted as old (already received) packets and discarded. If one side of the connection in question is a security sensor, for example, this attack can result in incorrect "ok" packets being sent, moving the window forward, and when real "alarm" packets are later sent (with earlier sequence numbers), these will be rejected by the receiver. Note that this observation does not have to be for a connection which the observing device is a part of; any un-encrypted connection (or encrypted connection that the observing device has credentials for) can be observed.

When executed perfectly, this attack may be difficult to detect, but when a pre-determined number of packets are seen which have identical sequence numbers, but differing content, a jamming condition can be noted. This may indicate either the attacker guessed "wrong" and sent an "imposter" packet with a slightly too low sequence number, or the attacker has succeeded, moved the sequence number window forward, and the real party is now attempting to send actual data. In either case, the detecting party can interpret this as jamming.

As with some of the mechanisms described earlier, other failures that are not in fact jamming may also result on the observed behavior of network connection failure. This includes equipment failure, software failures, interference from other sources (e.g., a microwave oven interfering with a WiFi connection), etc.

When jamming is detected, action is taken by the detecting device. This may involve setting a flag or variable, sending a signal to an appropriate software process or hardware device, etc., and actions are taken as described below.

In the External Entity scenario, these attacks may be detected by any device on External Entity Telemetry Network, e.g., External Entity Sensor(s) 220, External Entity Mobile Device(s) 250, or another device on that network (not shown).

Jam/Reset Messages

According to some embodiments, a jamming device attempts to block information from a remote device (e.g., one or more of Sensor(s) 111, Communications Device(s) 112, and/or Additional Device(s) 113) from reaching Base Unit 110 using a reset attack, in which a spoofed protocol message, normally used to initiate tear down of the connection, is sent by the jamming device. An example of such an attack is the use of TCP reset (RST) messages to tear down connections, used by governments (e.g., the "Great Firewall of China"), service providers (e.g., Comcast against Peer-to-Peer applications in 2007), etc. In a stream of packets of a TCP connection, each packet contains a TCP header. Each of these headers contains a bit known as the "reset" (RST) flag. In most packets this bit is set to 0 and has no effect; however, if this bit is set to 1, it indicates to the receiving computer that the computer should immediately stop using the TCP connection; it should not send any more packets using the connection's identifying numbers, called ports, and discard any further packets it receives with headers indicating they belong to that connection. Other protocol mechanisms-which cause a connection to close and/or reset—can be used for such attacks, such as a "DEAUTH frame" in 802.11 wireless networks. Various detection mechanisms may be used to separate real protocol reset messages from attacker messages.

According to various embodiments, detection of protocol reset messages (e.g., TCP reset messages) is performed between devices (e.g., one of Base Unit 110, Sensor(s) 111, Communications Device(s) 112, and/or Additional Device(s) 113). Generally, protocol reset messages occur infrequently in a well-functioning network in premises 105. Accordingly, if protocol reset message are discovered in a network in premises 105 more than once a minute (or once in period of time within a range of 2-60 minutes), then jamming may be indicated. Detection of protocol reset messages causes jamming to be detected, and when jamming is detected, action is taken by the detecting device. This may involve setting a flag or variable, sending a signal to an appropriate software process or hardware device, etc., and actions are taken as described below. Note that this observation does not have to be for a connection which the observing device is a part of; any un-encrypted connection (or encrypted connection that the observing device has credentials for) can be observed.

In the External Entity scenario, these attacks may be detected by any device on External Entity Telemetry Network, e.g., External Entity Sensor(s) 220, External Entity Mobile Device(s) 250, or another device on that network (not shown).

Base Unit Detects Jamming

Figure 5:
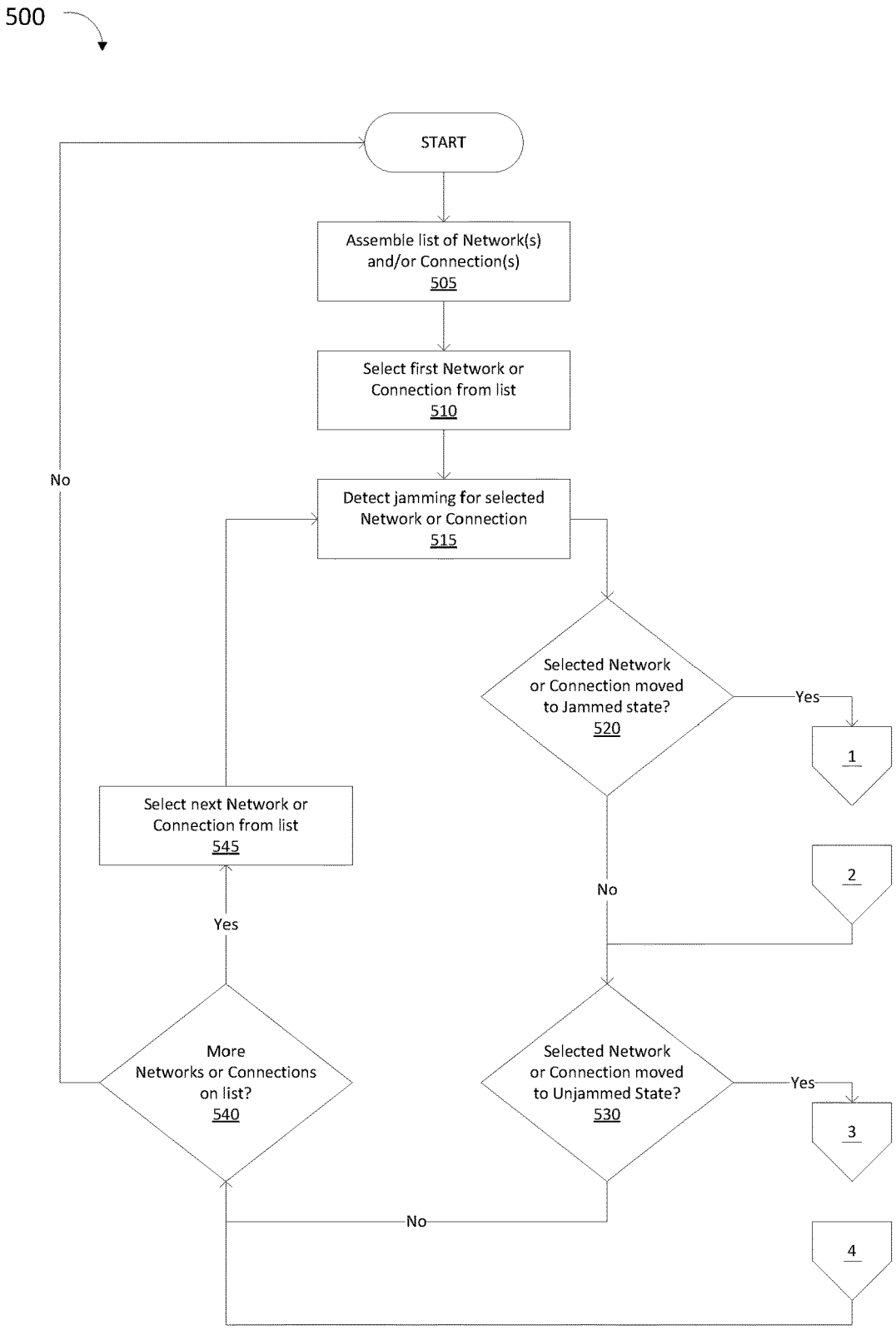
FIG. 5 is simplified flow diagram of a method for jamming detection, according to some embodiments.

FIG. 5 depicts method 500 for jamming detection by Base Unit 110, in some embodiments.

At step 505, a list of all available networks and connections (e.g., Data Network(s) 122, Telemetry Network(s) 123, and/or Internet Connection(s) 120) is assembled. This list may be pre-provisioned, or determined dynamically at the time step 505 occurs. At step 510, the first network or connection is selected, and method 500 proceeds to step 515.

At step 515, Base Unit 110 runs one or more of the measurement and evaluation techniques described above to determine if the selected network or connection is available. Alternatively or additionally, this may be performed by polling entities that are performing the detecting, polling flags that were previously set by the detection entities, etc., as opposed to actively applying the measurement and evaluation techniques.

Additionally or alternatively, the "detection" of jamming may occur when a notification is received from another device (e.g., Sensor(s) 111, Communications Device(s) 112, and/or Additional Device(s) 113), indicating that that other device detected jamming occurring in the system for the selected network. That is, the other device may actually detect the jamming using one of the measurement and evaluation techniques described above, and then notifies Base Unit 110.

At step 520 it can be determined if the selected network or connection has moved to a jammed state. That is, it is determined if it was previously not jammed and is now jammed. If jamming is newly detected for the selected network or connection, method 500 proceeds to connector 1, and on to method 600 of FIG. 6, where processing for the newly detected jam is performed. After completing method 600, method 500 returns and continues at connector 2, and proceeds to step 530.

If no jamming is detected at step 520, or if the network was already in a jammed state, method 500 proceeds to step 530, where the selected network is checked to see if it has recently become unjammed.

At step 530, it can be determined if the selected network or connection has just become unjammed. That is, if the selected network was previously in a jammed state and has now become unjammed. If the selected network has not just become unjammed, method 500 proceeds to step 540. If the selected network has just become unjammed, method 500 proceeds to connector 3, and on to method 700 of FIG. 7, where processing for the newly detected unjammed network is performed. After completing method 700, method 500 returns and continues at connector 4, and proceeds to 540.

At step 540, it can be determined if more networks or connections are available on the list assembled at step 505. If there are no further networks or connections to check, method 500 returns to the start. This loop of checking all networks then returning to start represents a waiting state where the system monitors for any jamming or unjamming that occurs on networks and connections. If more networks or connections are available at step 540, the next network or connection is selected at step 545, and method 500 returns to step 515 to examine this next network or connection.

Processing when Jam Detected

Figure 6:
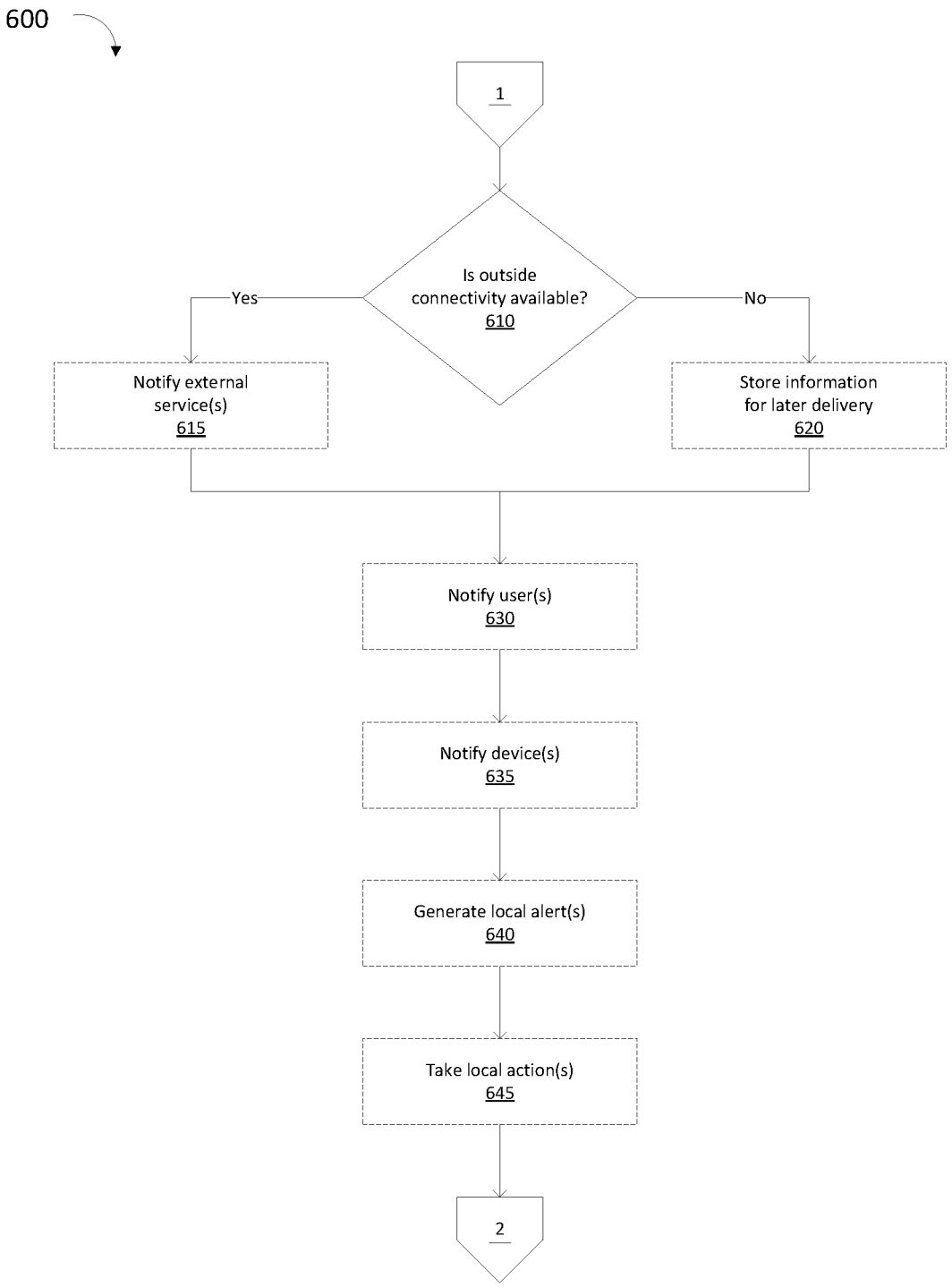
FIG. 6 is a simplified flow diagram of a method for remediation when a jam is detected, in accordance with various embodiments.

FIG. 6 illustrates method 600 for remediation when a jam is detected. Method 600 can commence at connector 1, and move to step 610, where it is determined if outside connectivity (i.e., connectivity to Internet 121) is still available. This may be achieved with active probes, passive traffic observation, or other means.

There are many circumstances where jamming may be occurring, but the Base Unit 110 still has outside connectivity. For example, the base unit may be connected to both a wireless Data Network 122 (e.g., Wi-Fi) and a wired Data Network. While wireless Data Network 122 may be jammed, the wired connection may still function. In another instance, wireless Data Network 122 (e.g., Wi-Fi) may be jammed, but the Base Unit has a second wireless Data Network, for example an LTE connection, which is not jammed. In another example, one or more Telemetry Network(s) 123, for example a DECT or BLE network may be jammed, preventing the Base Unit from connecting to one or more devices (e.g., Sensor(s) 111, Communications Device(s) 112, and/or Additional Device(s) 113) over the Telemetry Network, but one or more Data Network(s) is still available and providing connectivity to the outside world (e.g., to Internet 121).

If outside connectivity is still possible (e.g., available and not jammed), method 600 proceeds to step 615, where one or more external services are notified. Monitoring Service(s) 130, for example an alarm monitoring service/station, are optionally notified. In this context, there is external connectivity (as determined at step 610), allowing communication with the Monitoring Service. The service is alerted to the fact that jamming has occurred on the particular network selected at step 510 and/or 545. Additional information, for example the time of the jam and other information obtained may also be transmitted. Further actions, for example alerting appropriate authorities, may be initiated as appropriate by the Monitoring Service at this step. Other external services may also be notified, for example an off-site video recording service, a service that alerts a neighbor, etc. After alerting the Monitoring Service, method 600 continues to step 630.

If at step 610 it is determined that the outside connection is not available, then method 600 proceeds to step 620, where the information about which network or connection is jammed is stored/buffered. This information may include what is jammed, the time the jam began, and other information recorded about the jam condition. After storing the information about the jam, method 600 continues to step 630

At optional step 630, the user of the system is notified, typically by contacting User Device 140. In cases where outside connectivity is available, this may take the form of a telephone call or text message (e.g., initiated by Monitoring Service 130 or placed directly by action of Base Unit 110, optionally using Communications Service 131), an application push notification, or some other alert mechanism. The user may also be reached via notification to Other Services(s) 132. In cases where outside connectivity is unavailable, User Device may still be reachable over one or more of Data Network(s) 122 and/or Telemetry Network(s) 123. If available, these networks may be used to alert User Device (i.e., an internal User Device may be reachable over an unjammed local network even if outside connectivity is unavailable).

In some embodiments, the User Device 140 application may then allow the user to take other actions (e.g., triggering alarms, ignoring the alert, contacting authorities) as appropriate. In various embodiments, the system may only notify the user. After optionally alerting the user, method 600 continues to step 635.

At step 635, where possible, other devices within Premises 105 (e.g., Sensor(s) 111, Communications Device(s) 112, and/or Additional Device(s) 113) are optionally notified of the jamming condition. Depending on which network(s) are being jammed (e.g. Data Network(s) 122, Telemetry Network(s) 123), one or more devices may be unreachable if the network used by these devices for connectivity is unavailable. The devices may take appropriate action upon being notified of the jamming condition, as discussed in relation to method 900 of FIG. 9, for example by sounding an alarm or displaying a notification about jamming or taking more sophisticated action. After notifying devices, method 600 continues to step 640. If the original jamming detection took the form of a notification from a device (that is, another device detected the jamming and notified the Base Unit 110), that device may not be notified (or may ignore the notification) to prevent a loop condition.

At step 640, local alerts are optionally generated by Base Unit 110. This may include generating a sound which may be a simple notification sound, or may be a full siren-like alarm sound. Indicator lights on the Base Unit may be activated or change color to indicate the jamming condition. Messages or graphical indications may be displayed on any displays incorporated into or attached to the Base Unit. Various sounds, lights, or displays may indicate different jamming conditions, i.e., which networks are jammed, etc. As discussed later (see FIG. 7), the local alerts may change or be discontinued when the jamming ceases. For example, a loud alarm may sound during the jamming, but only a quieter, periodic alert intended to inform a user jamming has occurred may continue once the jamming has cleared. Similarly, a display or light may indicate jamming in progress while the jamming is ongoing, but change to a display indicating jamming has occurred when the jamming has cleared. After generating local alerts, method 600 continues to step 645.

At step 645, local actions are optionally taken by the Base Unit 110. This includes taking actions that might otherwise be taken by an external entity, e.g., Monitoring Service(s) 130. In one embodiment, the action taken may include notifying authorities (e.g., law enforcement). In another embodiment, the action may include instructing other devices connected to the system (e.g., Sensor(s) 111, Communications Device(s) 112, and/or Additional Device(s) 113) to take actions such as record video, activate door locks, turn on lights, etc.

After completing the optional actions, flow continues to step connector 3, and returns to the flow depicted in method 500 of FIG. 5.

Figure 7:
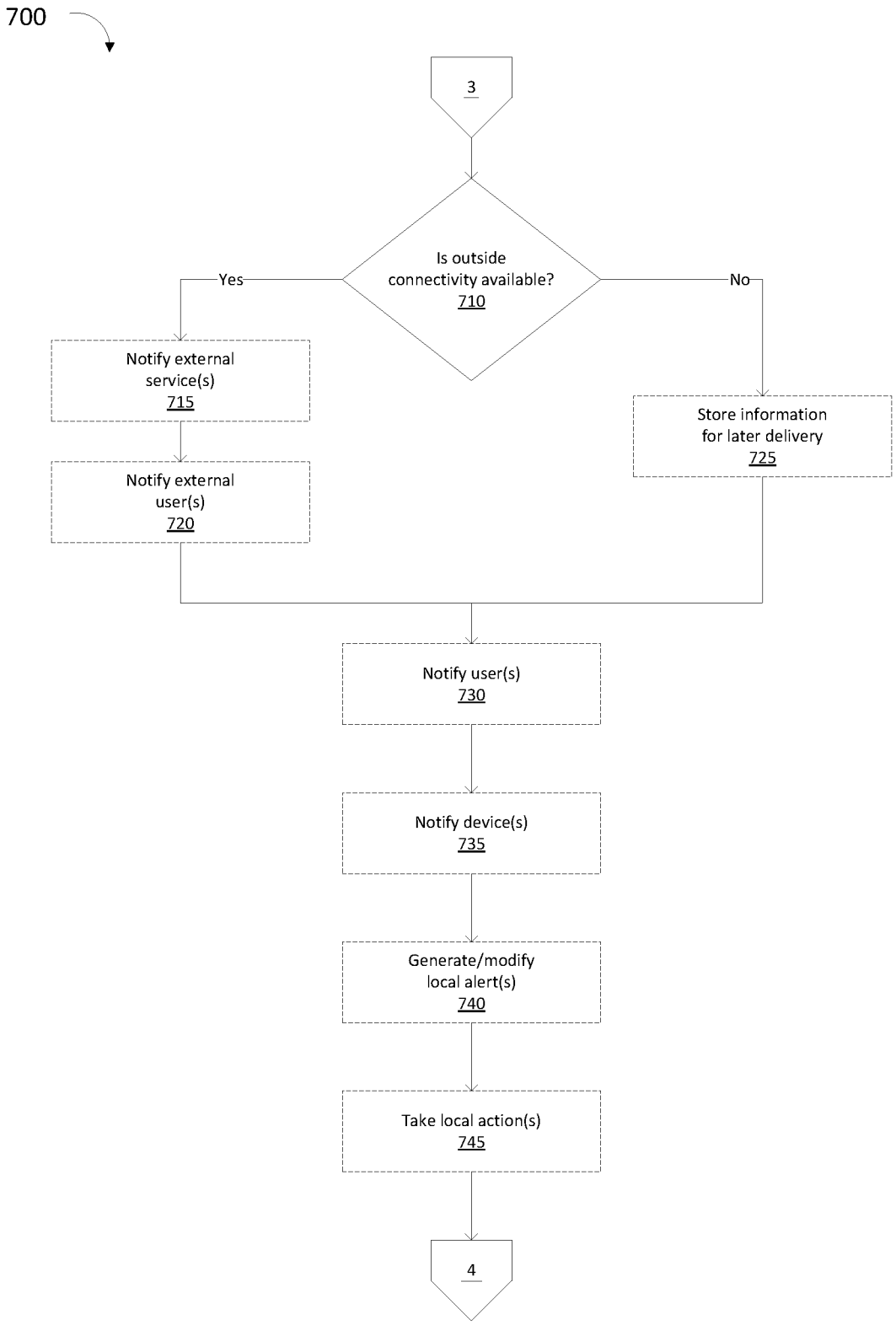
FIG. 7 is a simplified flow diagram of a method for remediation when a jam is cleared, according to some embodiments.

FIG. 7 depicts method 700 for remediation when a jam is cleared. Method 700 can commence at connector 3, and move step 710, where it is determined if outside connectivity (e.g., connectivity to Internet 121) has returned. This may be achieved with active probes, passive traffic observation, or other means. If external connectivity has returned, flow moves to step 715. If external connectivity has not returned, method 700 proceeds to step 725.

At step 715, any information about jams stored at step 620 of method 600 of FIG. 6 is relayed to external services, for example to Monitoring Service 130. The information relayed may include the duration of the jams, details about the jam, etc. Note that when connectivity returns, other jams may be ongoing, and this information will be conveyed to the external service. As with processing of jam information as discussed at step 615, further actions, for example alerting appropriate authorities (e.g., police), may be initiated as appropriate by the Monitoring Service at this step.

At step 720, notifications to users, for example via User Device 140 are delivered. If the User Device was not reachable via Data Network(s) 122 or Telemetry Network(s) 123 at step 630 of method 600, and external connectivity was not available, the user is now informed via the (now available) external connection. As with step 630, this notification may take several forms, and in some cases, the user may respond or take action based on this notification. Notification may include full details of the jam condition that has now resolved, as well as information about other jams that has been stored and not yet delivered.

At step 725, information about the jam that has resolved is stored to be transmitted when external connectivity returns. This information will be delivered later (at steps 715 and 720) when connectivity is restored. This step is analogous to step 620 in method 600.

At step 730, the user of the system is optionally notified that a network or connection has become unjammed. In cases where external connectivity has just become available, this step and the previous step 720 are substantially the same, but in cases where one or more networks or connections becomes unjammed and external connectivity is still not possible, local notifications may be delivered to a User Device 140 using a premises network (e.g. Data Network(s) 122 and/or Telemetry Network(s) 123) at this step. Notification may include full details of the jam condition that has now resolved, as well as information about other jams that has been stored and not yet delivered.

In some embodiments, an application running on User Device 140 may then allow the user to take other actions (e.g., triggering alarms, ignoring the alert, contacting authorities) as appropriate. In other embodiments, the system may only notify the user. After alerting the user, method 700 continues to step 735.

At step 735, where possible, other devices in or about Premises 105 (e.g., Sensor(s) 111, Communications Device(s) 112, and/or Additional Device(s) 113) are optionally notified of the jamming condition which has now cleared. Note that depending on which network(s) are being jammed and which have had jams clear (e.g. Data Network(s) 122, Telemetry Network(s) 123), one or more devices may be unreachable if the network used by these devices for connectivity is unavailable. The devices may take appropriate action upon being notified of the clearing of the jamming condition, as discussed in method 1000 of FIG. 10, for example by sounding a tone (or cancelling a tone indicating jamming) or displaying a notification about the jamming that has now resolved. After notifying devices, method 700 continues to step 740. If the original detection of resolution of jamming took the form of a notification from a device (that is, another device detected the unjamming and notified the Base Unit 110), that device may not be notified (or may ignore the notification) to prevent a loop condition.

At step 740, local alerts are optionally generated or modified by Base Unit 110 in response to detecting the change in jamming status. For example, an alarm that was activated at step 640 of method 600 of FIG. 6 may be silenced or modified (reduced) at this stage as the jam is detected as resolved. As with the alerts discussed at step 640, alerts may include sounds, lights, and other visual indicators being updated to indicate a jam has resolved. After generating or modifying local alerts, method 700 continues to step 745.

At step 745, local actions are optionally taken by the Base Unit 110 in response to the jam situation being resolved. Again, this may include taking actions that might otherwise be taken by an external entity, e.g., Monitoring Service(s) 130, such as notifying authorities, or changing the status of lights, locks, etc.

After completing the optional actions, method 700 continues to step connector 4, and returns to method 500 of FIG. 5.

Secondary Device Detects Jamming

Figure 8:
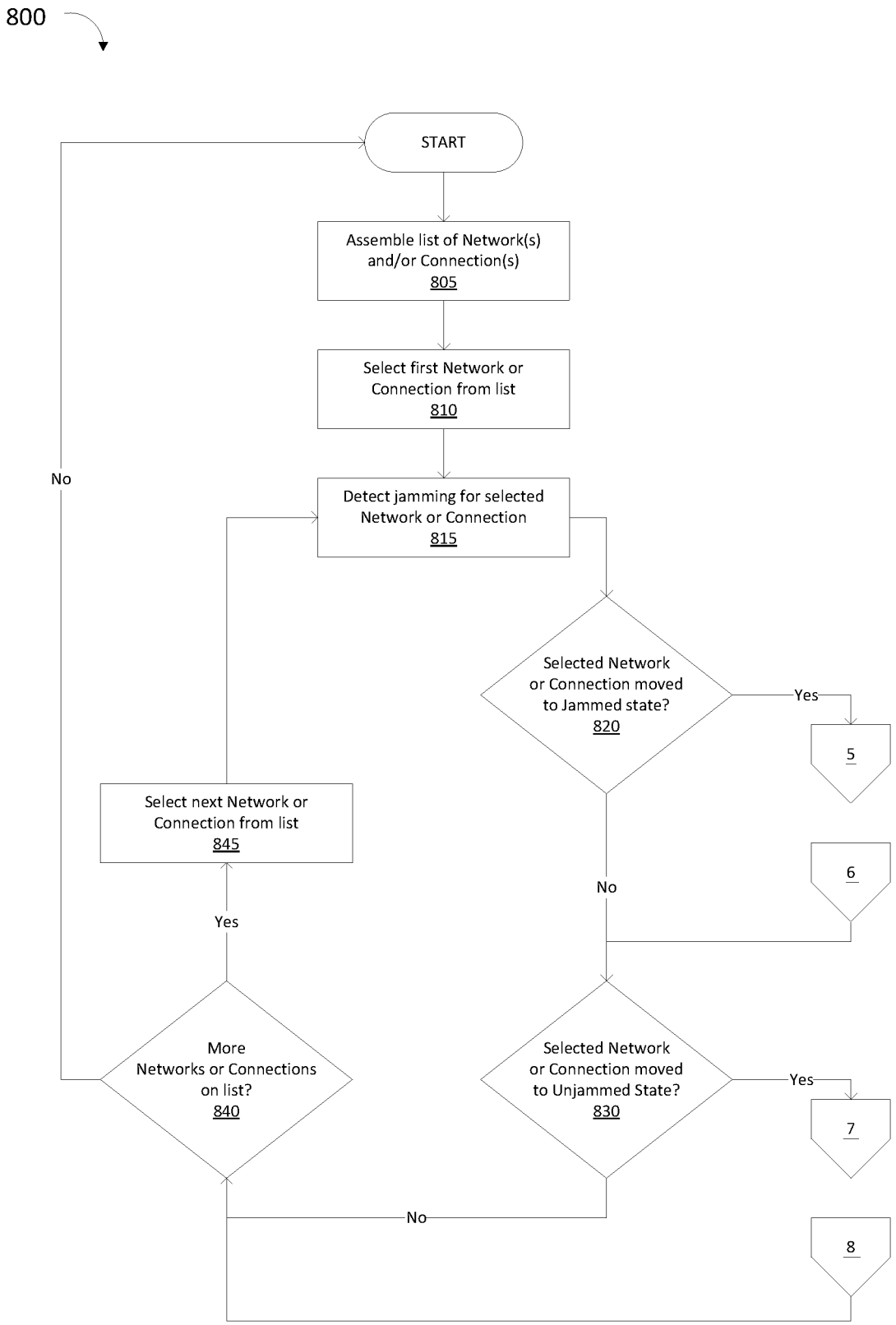
FIG. 8 is a simplified flow diagram of a method for remediation when a jam is detected, according to various embodiments.

FIG. 8 shows method 800 for remediation when a jam is detected by a secondary device. Secondary device may include one or more of Sensor(s) 111, Communications Device(s) 112, and/or Additional Device(s) 113. Method 800 is similar to method 500 of FIG. 5 followed by the Base Unit, but because the capabilities and role of the various devices differs slightly, it is described in more detail here.

For devices, explicit detection is optional. Some devices may monitor all available networks, while others may only react to notifications of jamming (when they are possible to receive) from other devices. As a result while many steps here are the same as for methods 500, 600 and 700, the actions performed may be more limited or optional here (e.g., steps 805 and 810) than in their Base Unit 110 counterparts.

At step 805, a list of all available networks and connections—that is Data Network(s) 122, Telemetry Network(s) 123, and/or Internet Connection(s) 120 is assembled. This list may be pre-provisioned, or determined dynamically at the time step 805 occurs. At step 810, the first network or connection is selected, and control moves to step 815. Note that for devices, the list of networks may (but not necessarily) be more limited than for the Base Unit 110. For example, in many cases Sensor(s) 111 may only have a connection to a Telemetry Network and not to a Data Network.

Regardless of whether the device is monitoring for jamming itself, at step 815 "detection" of jamming may occur when a notification is received from Base Unit 110 or another device (e.g., Sensor(s) 111, Communications Device(s) 112, and/or Additional Device(s) 113), indicating that the other device detected jamming occurring in the system for the selected network. That is, the other device or Base Unit detects the jamming using one of the techniques described earlier, and then notifies the device.

If the device is monitoring for jamming directly itself, at step 815, the device performs one or more of the methods described earlier to determine if the selected network or connection is available. Note that this also may be performed by polling entities that are performing the detecting, polling flags that were previously set by the detection entities, etc., rather than actively running detection methods.

At step 820 it is determined if the selected network or connection has moved to a jammed state. That is, it is determined if it was previously not jammed and is now jammed. If jamming is newly detected for the selected network or connection, method 800 proceeds to connector 5, and on to method 900 of FIG. 9, where processing for the newly detected jam is performed. After completing method 900, method 800 returns and continues at connector 6, and moves on to step 830

If no jamming is detected at step 820, or if the network was already in a jammed state, flow moves to step 830, where the selected network is checked to see if it has recently become unjammed.

At step 830, it is determined if the selected network or connection has just become unjammed. That is, if the selected network was previously in a jammed state and has now become unjammed. If the selected network has not just become unjammed, method 800 proceeds to step 840. If the selected network has just become unjammed, method 800 proceeds to connector 7, and on to method 1000 in FIG. 10, where processing for the newly detected unjammed network is performed. After completing method 800, method 800 returns and continues at connector 8, and moves on to step 840

At step 840, it is determined if more networks or connections are available on the list assembled at step 805. If there are no further networks or connections to check, method 800 returns to the start. This loop of checking all networks then returning to start represents a waiting state where the system monitors for any jamming or unjamming that occurs on networks and connections. If more networks or connections are available at step 840, the next network or connection is selected at step 845, and method 600 returns to step 815 to examine this next network or connection.

Processing when Jam Detected

Figure 9:
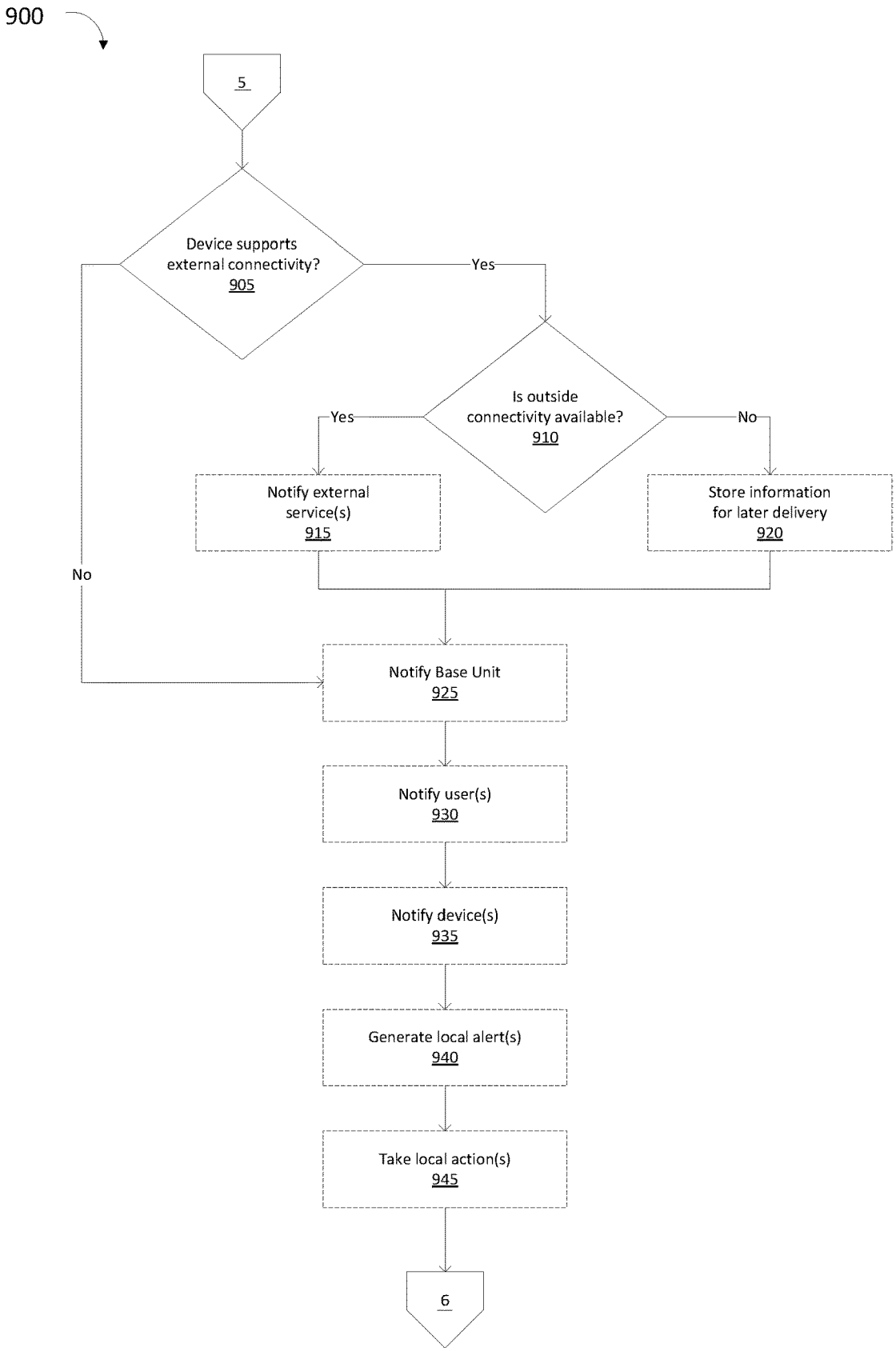
FIG. 9 is a simplified flow diagram of a method for remediation when a jam is detected, in accordance with some embodiments.

FIG. 9 depicts method 900 for remediation when a jam is detected by a device. While this diagram is analogous to method 600, and offers many of the same actions, not all devices will offer all these capabilities or execute all steps. A sophisticated device, for example a self-contained automated thermostat may execute all or nearly all steps, while in an extreme case a very simple window open detection switch may simply send information to Base Unit 110, and will perform no processing or actions at all.

Method 900 can commence at connector 7, and move to step 905, where it is determined if the device supports outside (external) connectivity. For example, a device equipped with Wi-Fi capabilities may connect to a Data Network(s) 122 and support external connectivity, while a simpler device may only connect to a Telemetry Network(s) 123 and not support outside connectivity. If outside connectivity is supported, method 900 proceeds to step 910 where the connectivity is checked. If outside connectivity is not supported, method 900 proceeds to step 925.

At step 910 it is determined if outside connectivity (e.g., connectivity to Internet 121) is functional (available and not jammed). This may be achieved with active probes, passive traffic observation, or other means. Again, only some devices (generally the more sophisticated) will have outside connectivity, and will perform this step.

For devices that do have external connectivity capability and the external connection is functioning as determined at steps 905 and 910, method 900 proceeds to step 915, where one or more external services (e.g., Monitoring Service(s) 130) are notified. Some home devices may connect and share information with Base Unit 110, but may also have their own independent monitoring services, which are notified of the jamming condition at this step. As discussed earlier in the discussion of method 600 of FIG. 6, additional information may be conveyed, various services may be contacted, and actions taken by those services in response to the jamming detection. After sending the information, method 900 continues to step 925.

If at step 910 it is determined that the outside connection is not functional, method 900 proceeds to step 920, where the information about which network or connection is jammed is stored. This information may include what is jammed, the time the jam began, and other information recorded about the jam condition. After storing the information about the jam, method 900 continues to step 925.

At optional step 925, Base Unit 110 is notified about the jam detected. Depending on which network(s) are being jammed (e.g., Data Network(s) 122, Telemetry Network(s) 123), Base Unit 110 may be unreachable if the network used by the device for connectivity to Base Unit 110 is unavailable. If connectivity to Base Unit 110 is unavailable, this information is stored to be relayed to Base Unit 110 when connectivity returns. If the source of the jamming information at step 815 was Base Unit 110, the device may not relay the information back to Base Unit 110 (or it may ignore the information) to prevent a loop condition. The information sent to Base Unit 110 or stored to send at a later time may include what is jammed, the time the jam began, and other information recorded about the jam condition. Once the information is transmitted to Base Unit 110 or stored, method 900 proceeds to step 930.

At optional step 930, the user of the system is notified, typically by contacting User Device 140. In cases where outside connectivity is supported and available, this may take the form of a telephone call or text message (initiated by Monitoring Service 130 or placed directly by action of device, optionally using Communications Service 131), an application push notification, or some other alert mechanism. The user may also be reached via notification to Other Services(s) 132. In cases where outside connectivity is unavailable, or where the device has no external connectivity capability, User Device may still be reachable over one or more of Data Network(s) 122 and/or Telemetry Network(s) 123. If available, these networks may be used to alert User Device.

In some embodiments, an application running on User Device 140 may then allow the user to take other actions (e.g., triggering alarms, ignoring the alert, contacting authorities) as appropriate. In other embodiments, the system may only notify the user. After optionally alerting the user, method 900 continues to step 935.

At step 935, where possible, other devices within the Premises 105 excluding Base Unit 110 (e.g., Sensor(s) 111, Communications Device(s) 112, and/or Additional Device(s) 113) are optionally notified of the jamming condition. Note that depending on which network(s) are being jammed (e.g. Data Network(s) 122, Telemetry Network(s) 123), one or more devices may be unreachable if the network used by these devices for connectivity is unavailable. The devices may then detect this as a jam condition themselves (see step 815 of method 800 in FIG. 8E) and take action by executing the flow described by method 900 themselves. Note that if the original jamming detection took the form of a notification from a device (that is, another device detected the jamming and notified the device performing this step), that device may not be notified (or may ignore the notification) to prevent a loop condition.

At step 940, local alerts are optionally generated by the device. This may include generating a sound which may be a simple notification sound, or may be a full siren-like alarm sound. Indicator lights on the device may be activated or change color to indicate the jamming condition. Messages or graphical indications may be displayed on any displays incorporated into or attached to the device. Various sounds, lights, or displays may indicate different jamming conditions, i.e., which networks are jammed, etc. As discussed later (See FIG. 10), the local alerts may change or be discontinued when the jamming ceases. For example, a loud alarm may sound during the jamming, but only a quieter, periodic alert intended to inform a user jamming has occurred may continue once the jamming has cleared. Similarly, a display or light may indicate jamming in progress while the jamming is ongoing, but change to a display indicating jamming has occurred when the jamming has cleared. Some devices may not have any mechanism to alert about the jamming condition, and no action is performed at this step. After generating local alerts, method 900 continues to step 945.

At step 945, local actions are optionally taken by the device. This includes taking actions that might otherwise be taken by an external entity, e.g., Monitoring Service(s) 130. The action taken may include notifying authorities. The action may include instructing other devices connected to the system (e.g., Sensor(s) 111, Communications Device(s) 112, and/or Additional Device(s) 113) to take actions such as record video, activate door locks, turn on lights, etc. Again, less sophisticated devices may take no action here, expecting that such actions will be taken by Base Unit 110 after the notification is sent at step 915.

After completing the optional actions, method 9 continues to step connector 6, and returns to flow chart 800.

Unjamming Detected

Figure 10:
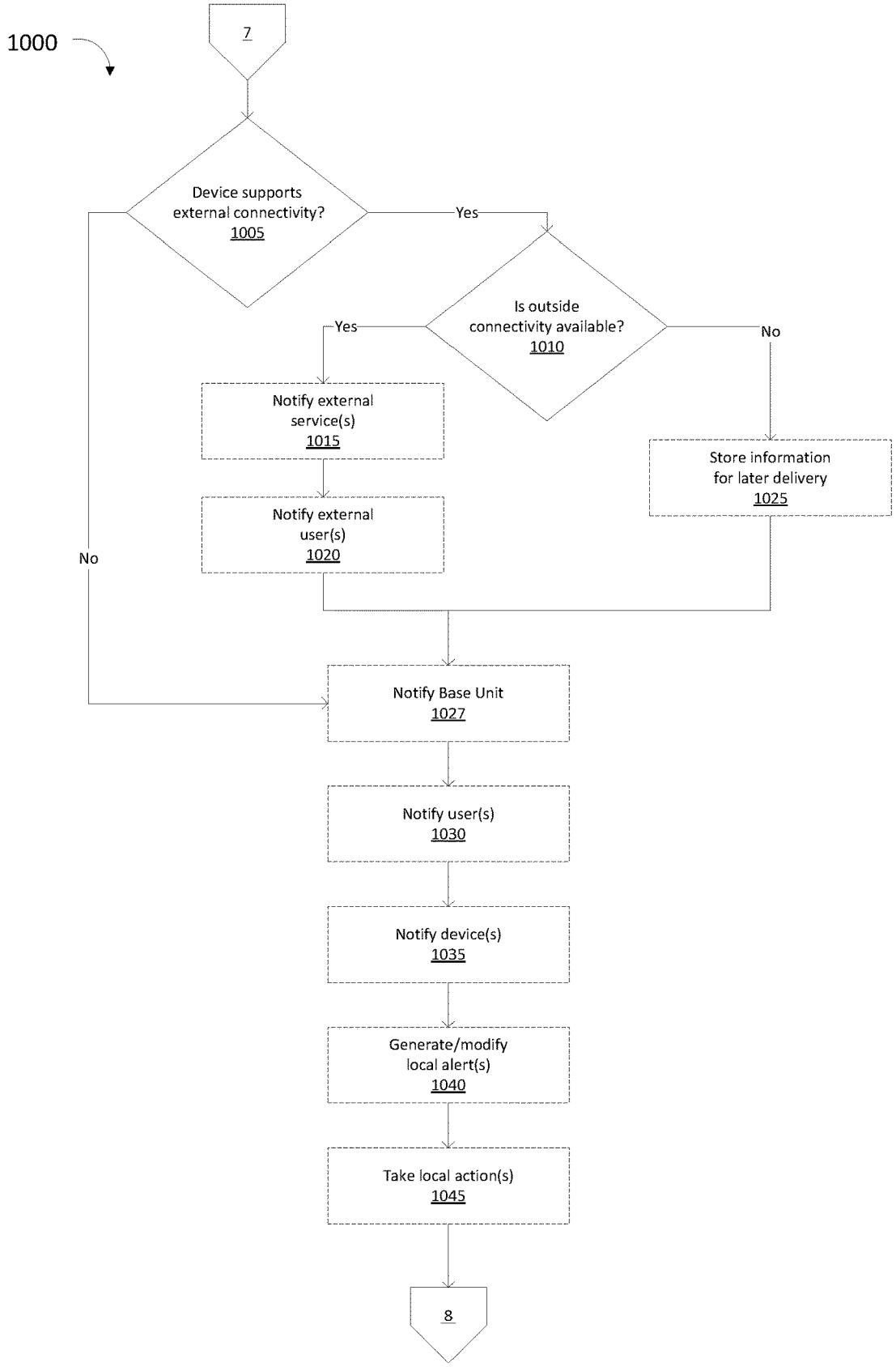
FIG. 10 is a simplified flow diagram of a method for remediation when a jam is cleared, in accordance with various embodiments.

FIG. 10 shows method 1000 for remediation when a jam is cleared. Method 1000 can commence at connector 7, and move step 1005 where it is determined if the device supports outside (external) connectivity. For example, a device equipped with Wi-Fi capabilities may connect to a Data Network(s) 122 and support external connectivity, while a simpler device may only connect to a Telemetry Network(s) 123 and not support outside connectivity, If outside connectivity is supported, method 1000 proceeds to step 1010 where the connectivity is checked. If outside connectivity is not supported, method 1000 proceeds to step 1027.

At step 1010, it is determined if outside connectivity (e.g., connectivity to Internet 121) has returned. This may be achieved with active probes, passive traffic observation, or other means. Again, only some devices (generally the more sophisticated) will have outside connectivity, and will perform this step. If external connectivity has returned, method 1000 proceeds to step 1015. If external connectivity has not returned, method 1000 proceeds to step 1025.

At step 1015, any information about jams stored at step 920 of method 900 is relayed to external services, for example to Monitoring Service 130. Additional information, for example the time of the jam and other information obtained may also be transmitted. Further actions, for example alerting appropriate authorities, may be initiated as appropriate by the Monitoring Service at this step. After alerting the Monitoring Service, method 1000 continues to step 1027.

At step 1020, notifications to users, for example via User Device 140 are delivered. If User Device 140 was not reachable via Data Network(s) 122 or Telemetry Network(s) 123 at step 930 of method 900 of FIG. 9, and external connectivity was not available, the user is now informed via the (now available) external connection. As with step 930, this notification may take several forms, and in some cases, the user may respond or take action based on this notification. Notification may include full details of the jam condition that has now resolved, as well as information about other jams that has been stored and not yet delivered.

At step 1025, information about the jam that has resolved is stored to be transmitted when external connectivity returns. This information will be delivered later (e.g., at steps 1015 and 1020) when connectivity is restored. This step is analogous to step 920 in method 900 of FIG. 9.

At optional step 1027, Base Unit 110 is notified about the jam resolving. Depending on which network(s) are being jammed (e.g., Data Network(s) 122, Telemetry Network(s) 123), Base Unit 110 may be unreachable if the network used by the device for connectivity to Base Unit 110 is unavailable. If connectivity to Base Unit 110 is unavailable, this information is stored to be relayed to the Base Unit when connectivity returns. If the unjamming has made the Base Unit available, any stored information (stored either at this step in a prior iteration, or at step 920 of method 900) is also transmitted to Base Unit 110. If the source of the unjamming information at step 815 was Base Unit 110, the device may not relay the information back to Base Unit 110 (or it may ignore the information) to prevent a loop condition. The information sent to Base Unit 110 or stored to send at a later time may include what is jammed (or has become unjammed), the time the jam began and ended, and other information recorded about the jam condition. Once the information is transmitted to Base Unit 110 or stored, method 1000 proceeds to step 1030.

At step 1030, the user of the system is optionally notified that a network or connection has become unjammed. In cases where external connectivity is supported and has just become available (has become unjammed), this step and the previous step 1020 are substantially the same, but in cases where one or more networks or connections becomes unjammed, but external connectivity is still not possible, local notifications may be delivered to a User Device 140 using a premises network (e.g., Data Network(s) 122 and/or Telemetry Network(s) 123) at this step. Notification may include full details of the jam condition that has now resolved, as well as information about other jams that has been stored and not yet delivered.

In some embodiments, an application running on User Device 140 may then allow the user to take other actions (e.g., triggering alarms, ignoring the alert, contacting authorities) as appropriate. In other embodiments, the system may only notify the user. After alerting the user, method 1000 continues to step 1035.

At step 1035, where possible, other devices within Premises 105 excluding Base Unit 110 (e.g., Sensor(s) 111, Communications Device(s) 112, and/or Additional Device(s) 113) are optionally notified of the jamming condition which has now cleared. Depending on which network(s) are being jammed and which have had jams clear (e.g., Data Network(s) 122, Telemetry Network(s) 123), one or more devices may be unreachable if the network used by these devices for connectivity is unavailable. These devices may themselves take appropriate action upon being notified of the clearing of the jamming condition, as discussed in method 1000. If the original detection of resolution of jamming took the form of a notification from another device (that is, another device detected the unjamming and notified the device performing this step), that device may not be notified (or may ignore the notification) to prevent a loop condition.

At step 1040, local alerts are optionally generated or modified by Base Unit 110 in response to detecting the change in jamming status. For example, an alarm that was activated at step 940 of flowchart 900 may be silenced or modified (reduced) at this stage as the jam is detected as resolved. As with the alerts discussed at step 640, alerts may include sounds, lights, and other visual indicators being updated to indicate a jam has resolved. Some devices may not have any mechanism to alert about the jamming condition, and no action is performed at this step. After generating or modifying local alerts, method 1000 continues to step 1045.

At step 1045, local actions are optionally taken by the device in response to the jam situation being resolved. Again, this may include taking actions that might otherwise be taken by an external entity, e.g., Monitoring Service(s) 130, such as notifying authorities, or changing the status of lights, locks, etc. Again, less sophisticated devices may take no action here, expecting that such actions will be taken by Base Unit 110 after the notification is sent at step 1027.

After completing the optional actions, method 1000 continues to step connector 8, and returns to method 800 of FIG. 8.

Tamper Notifications

Devices (e.g., Base Unit 110, Sensor(s) 111, Communications Device(s) 112, and/or Additional Device(s) 113) detecting jams may buffer jamming information to transmit this information later when a jam resolves, as discussed earlier. Additionally, devices may assume a device that is jammed and then returns or reboots after a jam has been tampered with, and send appropriate notification of the tamper—for example by notifying other devices on the premises (e.g., Base Unit 110, Sensor(s) 111, Communications Device(s) 112, and/or Additional Device(s) 113); by notifying services (e.g., Monitoring Service(s) 130, Communications Service(s) 131, Other Service(s) 132, or User Device(s) 140); by setting off local alerts, etc.

Jam Detection vs. Alerts

While both situations may require notification of the monitoring system, user, and/or authorities, detection of jamming or tampering situations are different than detection of an actual alarm condition (e.g., door opening, window breaking, etc.). In one implementation, detection of a jamming situation includes conveying the information that a jam or tamper, and not an actual breach of the alarm system, has occurred when contacting public safety authorities. This action has the potential to reduce the risk or severity of "SWATing" style attacks that include an attempt to use jamming to set off a premises alarm system.

External Entity Jam Notifications

In the case of jam detection in the External Entity scenario, jamming may be detected (e.g., using the mechanisms described earlier) by one or more of External Entity Sensor(s) 220, External Entity Mobile Device(s) 250, and/or External Entity 210. Indication of jamming may be buffered to report when a connection is jam is cleared, when an External Entity Mobile Device is within range, etc. Indication of the jam may be used to require a manual verification of the equipment the sensor is monitoring, alert authorities of potential fraud, etc.

Figure 11:
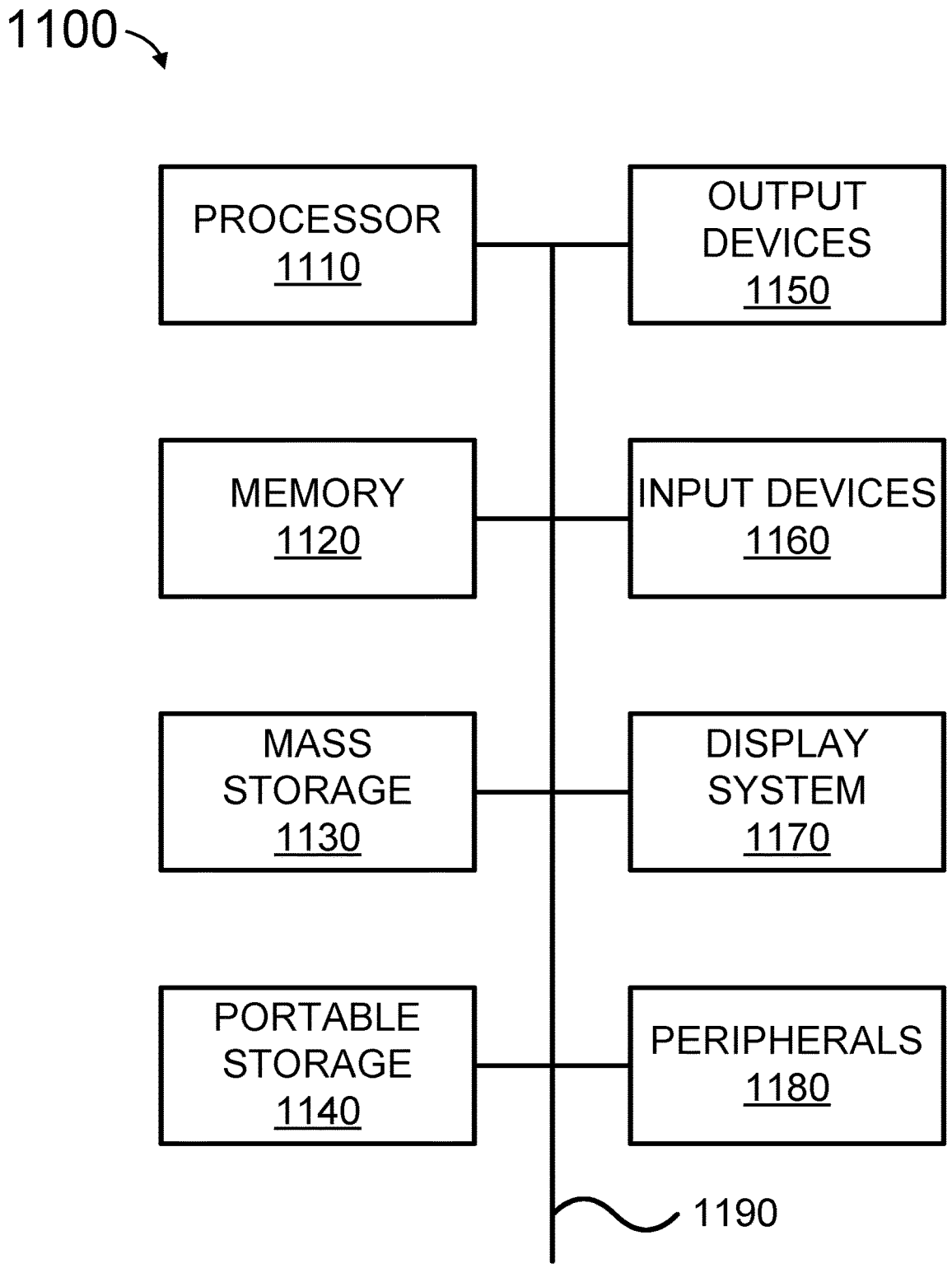
FIG. 11 is a simplified block diagram of a computing system, according to some embodiments.

FIG. 11 illustrates an exemplary computer system 1100 that may be used to implement some embodiments of the present invention. The computer system 1100 in FIG. 11 may be implemented in the contexts of the likes of computing systems, networks, servers, or combinations thereof. The computer system 1100 in FIG. 11 includes one or more processor unit(s) 1110 and main memory 1120. Main memory 1120 stores, in part, instructions and data for execution by processor unit(s) 1110. Main memory 1120 stores the executable code when in operation, in this example. The computer system 1100 in FIG. 11 further includes a mass data storage 1130, portable storage device 1140, output devices 1150, user input devices 1160, a graphics display system 1170, and peripheral device(s) 1180.

The components shown in FIG. 11 are depicted as being connected via a single bus 1190. The components may be connected through one or more data transport means. Processor unit(s) 1110 and main memory 1120 are connected via a local microprocessor bus, and the mass data storage 1130, peripheral device(s) 1180, portable storage device 1140, and graphics display system 1170 are connected via one or more input/output (I/O) buses.

Mass data storage 1130, which can be implemented with a magnetic disk drive, solid state drive, or an optical disk drive, is a non-volatile storage device for storing data and instructions for use by processor unit(s) 1110. Mass data storage 1130 stores the system software for implementing embodiments of the present disclosure for purposes of loading that software into main memory 1120.

Portable storage device 1140 operates in conjunction with a portable non-volatile storage medium, such as a flash drive, floppy disk, compact disk, digital video disc, or Universal Serial Bus (USB) storage device, to input and output data and code to and from the computer system 1100 in FIG. 11. The system software for implementing embodiments of the present disclosure is stored on such a portable medium and input to the computer system 1100 via the portable storage device 1140.

User input devices 1160 can provide a portion of a user interface. User input devices 1160 may include one or more microphones, an alphanumeric keypad, such as a keyboard, for inputting alphanumeric and other information, or a pointing device, such as a mouse, a trackball, stylus, or cursor direction keys. User input devices 1160 can also include a touchscreen. Additionally, the computer system 1100 as shown in FIG. 11 includes output devices 1150. Suitable output devices 1150 include speakers, printers, network interfaces, and monitors.

Graphics display system 1170 include a liquid crystal display (LCD) or other suitable display device. Graphics display system 1170 is configurable to receive textual and graphical information and processes the information for output to the display device.

Peripheral device(s) 1180 may include any type of computer support device to add additional functionality to the computer system.

The components provided in the computer system 1100 in FIG. 11 are those typically found in computer systems that may be suitable for use with embodiments of the present disclosure and are intended to represent a broad category of such computer components that are well known in the art. Thus, the computer system 1100 in FIG. 11 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

In some embodiments, the computing system 1100 may be implemented as a cloud-based computing environment, such as a virtual machine operating within a computing cloud. In other embodiments, the computing system 1100 may itself include a cloud-based computing environment, where the functionalities of the computing system 1100 are executed in a distributed fashion. Thus, the computing system 1100, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud is formed, for example, by a network of web servers that comprise a plurality of computing devices, such as the computing system 1100 with each server (or at least a plurality thereof) providing processor and/or storage resources. These servers manage workloads provided by multiple users (e.g., cloud resource customers or other users). Typically, each user places workload demands upon the cloud that vary in real-time, sometimes dramatically. The nature and extent of these variations typically depends on the type of business associated with the user.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical, magnetic, and solid-state disks, such as a fixed disk. Volatile media include dynamic memory, such as system random-access memory (RAM). Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a programmable read-only memory (PROM), an erasable programmable read-only memory (EPROM), an electrically erasable programmable read-only memory (EEPROM), a Flash memory, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as JAVA, SMALLTALK, C++ or the like and procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present technology are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

What is claimed is:

1. A method for network jamming detection and remediation, the method comprising:

detecting network jamming, wherein the detecting occurs by a base unit disposed in a residence, the detecting the network jamming includes:

measuring, using a radio, a signal strength over a slot time and over frequencies of a wireless network; and identifying the network jamming when the signal strength exceeds a predetermined threshold; and issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased;

wherein the base unit is coupled to at least one local area network (LAN) in the residence, is coupled to a wide area network using a broadband interface at the residence, and includes at least one of a radio for a wireless network radio and an interface to a wired network.

2. The method of claim 1, further comprising:

determining the network jamming has ceased; and terminating the issued alert.

3. The method of claim 1, wherein the detecting the network jamming includes:

receiving at least one predetermined threshold, the at least one predetermined threshold including at least one of a percentage of messages, bytes, and segments over a predetermined time period being corrupted;

measuring the at least one of the percentage of messages, bytes, and segments over a predetermined time period that are corrupted for each device of a plurality of devices on the at least one LAN; and determining the at least one measurement exceeds the least one predetermined threshold.

4. The method of claim 1, wherein the detecting the network jamming includes:

identifying messages between devices on the at least one LAN that are at least one of improperly authenticated, improperly signed, and improperly encrypted, or are at least one of not authenticated, not signed, and not encrypted within an expected time.

5. The method of claim 1, wherein the detecting the network jamming includes:

receiving notice from another device on the at least one LAN indicating there is jamming.

6. The method of claim 1, wherein the detecting the network jamming includes:

detecting a beacon pulse associated with the base unit and originating from a source other than the base unit.

7. The method of claim 1, wherein the detecting the network jamming includes:

determining at least one of a number of packets having erroneous sequence numbers exceeds a predetermined threshold and a number of packets having the same sequence number exceeds another predetermined threshold.

8. A base unit comprising:

a processor; and a memory coupled to the processor and storing a program executable by the processor to perform a method for network jamming detection and remediation comprising:

detecting network jamming, the base unit being disposed in a residence, the detecting the network jamming includes:

measuring, using a radio, a signal strength over a slot time and over frequencies of a wireless network; and identifying the network jamming when the signal strength exceeds a predetermined threshold; and issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased;

wherein the base unit is coupled to at least one local area network (LAN) in the residence, is coupled to a wide area network using a broadband interface at the residence, and includes at least one of a radio for a wireless network radio and an interface to a wired network.

9. The base unit of claim 8, wherein the method further comprises:

determining the network jamming has ceased; and terminating the issued alert.

10. The base unit of claim 8, wherein the detecting the network jamming includes:

receiving at least one predetermined threshold, the at least one predetermined threshold including at least one of a percentage of messages, bytes, and segments over a predetermined time period being corrupted;

measuring the at least one of the percentage of messages, bytes, and segments over a predetermined time period that are corrupted for each device of a plurality of devices on the at least one LAN; and determining the at least one measurement exceeds the least one predetermined threshold.

11. The base unit of claim 8, wherein the detecting the network jamming includes:

identifying messages between devices on the at least one LAN that are at least one of improperly authenticated, improperly signed, and improperly encrypted, or are at least one of not authenticated, not signed, and not encrypted at an expected time.

12. The base unit of claim 8, wherein the detecting the network jamming includes:

receiving notice from another device on the at least one LAN indicating there is jamming.

13. The base unit of claim 8, wherein the detecting the network jamming includes:

detecting a beacon pulse associated with the base unit and originating from a source other than the base unit.

14. The base unit of claim 8, wherein the detecting the network jamming includes:

determining at least one of a number of packets having erroneous sequence numbers exceeds a predetermined threshold and a number of packets having the same sequence number exceeds another predetermined threshold.

15. A system for network jamming detection and remediation comprising:

means for detecting, by a base unit disposed in a residence, network jamming, the means for detecting the network jamming includes:

means for measuring, using a radio, a signal strength over a slot time and over frequencies of a wireless network; and means for identifying the network jamming when the signal strength exceeds a predetermined threshold;

means for issuing an alert in response to the detected network jamming, the alert being at least one of: sounding an audible alarm, showing a visual alarm indication, and communicating with law enforcement;

means for buffering the alert when the alert cannot be issued due to the network jamming; and means for issuing the alert when the network jamming has ceased;

wherein the base unit is coupled to at least one local area network (LAN) in the residence, is coupled to a wide area network using a broadband interface at the residence, and includes at least one of a radio for a wireless network radio and an interface to a wired network.

16. A method for network jamming detection and remediation, the method comprising:

detecting network jamming, wherein the detecting occurs by a base unit disposed in a residence, the detecting the network jamming includes:

receiving at least one predetermined threshold, the at least one predetermined threshold including at least one of a percentage of messages, bytes, and segments over a predetermined time period being corrupted;

measuring the at least one of the percentage of messages, bytes, and segments over a predetermined time period that are corrupted for each device of a plurality of devices on at least one LAN; and determining the at least one measurement exceeds the least one predetermined threshold;

issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased;

wherein the base unit is coupled to at least one local area network (LAN) in the residence, is coupled to a wide area network using a broadband interface at the residence, and includes at least one of a radio for a wireless network radio and an interface to a wired network.

17. A method for network jamming detection and remediation, the method comprising:

detecting network jamming, wherein the detecting occurs by a base unit disposed in a residence, the detecting the network jamming includes identifying messages between devices on at least one local area network (LAN) that are at least one of improperly authenticated, improperly signed, and improperly encrypted, and are at least one of not authenticated, not signed, and not encrypted within an expected time;

issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased;

wherein the base unit is coupled to the at least one LAN in the residence, is coupled to a wide area network using a broadband interface at the residence, and includes at least one of a radio for a wireless network radio and an interface to a wired network.

18. A method for network jamming detection and remediation, the method comprising:

detecting network jamming, wherein the detecting occurs by a base unit disposed in a residence, the detecting the network jamming includes receiving notice from another device on at least one local area network (LAN) indicating there is jamming, wherein the base unit is coupled to the least one LAN in the residence, is coupled to a wide area network using a broadband interface at the residence, and includes at least one of a radio for a wireless network radio and an interface to a wired network;

issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased.

19. A method for network jamming detection and remediation, the method comprising:

detecting network jamming, wherein the detecting occurs by a base unit disposed in a residence, the detecting the network jamming includes detecting a beacon pulse associated with the base unit and originating from a source other than the base unit, wherein the base unit is coupled to at least one local area network (LAN) in the residence, is coupled to a wide area network using a broadband interface at the residence, and includes at least one of a radio for a wireless network radio and an interface to a wired network;

issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased.

20. A method for network jamming detection and remediation, the method comprising:

detecting network jamming, wherein the detecting occurs by a base unit disposed in a residence, the detecting the network jamming includes determining at least one of a number of packets having erroneous sequence numbers exceeds a predetermined threshold and a number of packets having the same sequence number exceeds another predetermined threshold, wherein the base unit is coupled to at least one local area network (LAN) in the residence, is coupled to a wide area network using a broadband interface at the residence, and includes at least one of a radio for a wireless network radio and an interface to a wired network;

issuing an alert in response to the detected network jamming, the alert being at least one of: sounding an audible alarm, showing a visual alarm indication, communicating with law enforcement, and communicating with an alarm monitoring station;

buffering the alert when the alert cannot be issued due to the network jamming; and issuing the alert when the network jamming has ceased.

* * * * *